US011210976B2

(12) United States Patent
Kim

(10) Patent No.: US 11,210,976 B2
(45) Date of Patent: Dec. 28, 2021

(54) METHOD OF SENSING THRESHOLD VOLTAGE IN DISPLAY PANEL, DISPLAY DRIVER INTEGRATED CIRCUIT PERFORMING THE SAME AND DISPLAY DEVICE INCLUDING THE SAME

(71) Applicant: SAMSUNG ELECTRONICS CO., LTD., Suwon-si (KR)

(72) Inventor: Jungmoon Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/791,498

(22) Filed: Feb. 14, 2020

(65) Prior Publication Data

US 2021/0020083 A1 Jan. 21, 2021

(30) Foreign Application Priority Data

Jul. 18, 2019 (KR) ..... 10-2019-0087048

(51) Int. Cl.
*G09G 3/00* (2006.01)
*G09G 3/3291* (2016.01)

(52) U.S. Cl.
CPC ..... *G09G 3/006* (2013.01); *G09G 3/3291* (2013.01); *G09G 2310/066* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 7,321,348 | B2 | 1/2008 | Cok et al. | |
| 7,551,164 | B2 | 6/2009 | Deane | |
| 9,125,278 | B2 | 9/2015 | Nathan et al. | |
| 9,390,652 | B2 | 7/2016 | Chang et al. | |
| 9,437,167 | B2 | 9/2016 | Shin et al. | |
| 9,620,053 | B2 | 4/2017 | Kim et al. | |
| 9,842,543 | B2 | 12/2017 | Zhou | |
| 9,892,688 | B2 | 2/2018 | In et al. | |
| 2011/0227505 | A1* | 9/2011 | Park | H05B 45/60 315/297 |
| 2014/0139510 | A1* | 5/2014 | Han | G09G 3/3233 345/212 |
| 2014/0192038 | A1 | 7/2014 | Qin et al. | |

* cited by examiner

*Primary Examiner* — Matthew Yeung
(74) *Attorney, Agent, or Firm* — Sughrue Mion, PLLC

(57) ABSTRACT

In a method of sensing a threshold voltage of a driving transistor in a pixel included in a display panel, a first initial level of a data voltage, a level of an initialization voltage and a second initial level of a reference voltage that are used for sensing the threshold voltage of the driving transistor are set. The reference voltage is different from the initialization voltage. The threshold voltage of the driving transistor is sensed by applying the initialization voltage, the data voltage having the first initial level and the reference voltage having the second initial level to the driving transistor. When a predetermined condition is not satisfied by variation in the threshold voltage of the driving transistor, at least one of the first initial level and the second initial level is changed. The threshold voltage of the driving transistor is sensed again based on a result of changing at least one of the first initial level and the second initial level.

18 Claims, 18 Drawing Sheets

METHOD OF SENSING THRESHOLD VOLTAGE IN DISPLAY PANEL, DISPLAY DRIVER INTEGRATED CIRCUIT PERFORMING THE SAME AND DISPLAY DEVICE INCLUDING THE SAME

CROSS-REFERENCE TO THE RELATED APPLICATION

This application is based on and claims priority under 35 USC § 119 to Korean Patent Application No. 10-2019-0087048, filed on Jul. 18, 2019 in the Korean Intellectual Property Office, the contents of which are herein incorporated by reference in their entirety.

BACKGROUND

1. Field

Example embodiments generally relate to semiconductor integrated circuits, and more particularly to methods of sensing threshold voltages in display panels, display driver integrated circuits performing the methods and display devices including the display driver integrated circuits.

2. Description of the Related Art

As information technology is developed, a display device becomes important to provide information to a user. Various display devices such as liquid crystal displays (LCDs), plasma displays, and electroluminescent displays have gained popularity. Among these, electroluminescent displays using light-emitting diodes (LEDs) or organic light-emitting diodes (OLEDs) that emit light through recombination of electrons and holes have quick response speeds and reduced power consumption.

The electroluminescent display has advantages of rapid response and low power consumption. Related art OLED display device supplies a current corresponding to a data signal using driving transistors of respective pixels to generate lights through the OLEDs of the respective pixels. As such, the electroluminescent display device displays an image using a current. The driving transistors and the OLEDs deteriorate with time of use, and to compensate for this deterioration, it is necessary to continuously sense the degree of deterioration.

SUMMARY

One or more example embodiments of the disclosure provides a method of efficiently sensing a threshold voltage of a driving transistor in a pixel included in a display panel.

One or more example embodiments of the disclosure provides a display driver integrated circuit that performs the method of sensing the threshold voltage.

One or more example embodiments of the disclosure provides a display device that includes the display driver integrated circuit.

According to an aspect of the disclosure, there is provided a method of sensing a threshold voltage of a driving transistor in a pixel included in a display panel, the method comprising: setting a first level of a data voltage, a second level of an initialization voltage and a third level of a reference voltage, the reference voltage being different from the initialization voltage; sensing the threshold voltage of the driving transistor by applying the initialization voltage having the second level, the data voltage having the first level and the reference voltage having the third level to the driving transistor; based on a condition related to the sensed threshold voltage not being satisfied, changing at least one of the first level of the data voltage or the third level of the reference voltage; and sensing the threshold voltage of the driving transistor again based on a result of the changing at least one of the first level or the second level.

According to another aspect of the disclosure, there is provided a display driver integrated circuit for driving a display panel including a plurality of pixels, each of the plurality of pixels including a driving transistor, the display driver integrated circuit comprising: a first voltage generator configured to generate an initialization voltage; a second voltage generator configured to generate a reference voltage, the reference voltage being different from the initialization voltage; a data driver configured to generate a data voltage; a memory configured to store a first level of the data voltage, a second level of the initialization voltage and a third level of the reference voltage; and a sensing circuit configured to: sense the threshold voltage of the driving transistor when the initialization voltage having the second level, the data voltage having the first level and the reference voltage having the third level are applied to the driving transistor, generate a control signal based on a condition related to the sensed threshold voltage not being satisfied, for changing at least one of the first level of the data voltage and the third level of the reference voltage, and sense the threshold voltage of the driving transistor again based on a result of the changing at least one of the first level and the third level.

According to another aspect of the disclosure, there is provided a display device comprising: a display panel comprising a plurality of pixels, each comprising a driving transistor; a data driver connected to a plurality of data lines of the display panel, and configured to generate a data voltage applied to the driving transistor; a scan driver connected to a plurality of scan lines of the display panel; a sensing driver connected to the display panel, and configured to control an operation of sensing a threshold voltage of the driving transistor; a first voltage generator configured to generate an initialization; a second voltage generator configured to generate a reference voltage, the reference voltage being different from the initialization voltage; a memory configured to store a first level of the data voltage, a second level of the initialization voltage and a third level of the reference voltage; wherein the sensing driver is configured to: sense the threshold voltage of the driving transistor when the initialization voltage having the second level, the data voltage having the first level and the reference voltage having the third level are applied to the driving transistor, generate a control signal based on a condition related to the sensed threshold voltage not being satisfied, for changing at least one of the first level of the data voltage and the third level of the reference voltage, and sense the threshold voltage of the driving transistor again based on a result of the changing at least one of the first level and the third level.

According to another aspect of the disclosure, there is provided a display apparatus for sensing a threshold voltage of a driving transistor in a pixel included in a display panel of the display apparatus, the display apparatus comprising: a memory storing one or more instructions; and a processor configured to execute the one or more instructions to: set a first level of a data voltage, a second level of an initialization voltage and a third level of a reference voltage, the reference voltage being different from the initialization voltage; sense the threshold voltage of the driving transistor by applying the initialization voltage having the second level, the data voltage having the first level and the reference voltage having the third level to the driving transistor; based on a condition related to the sensed threshold voltage not being satisfied, change at least one of the first level of the data voltage or the third level of the reference voltage; and sense the threshold voltage of the driving transistor again based on a result of the changing at least one of the first level or the second level.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Figure 1:
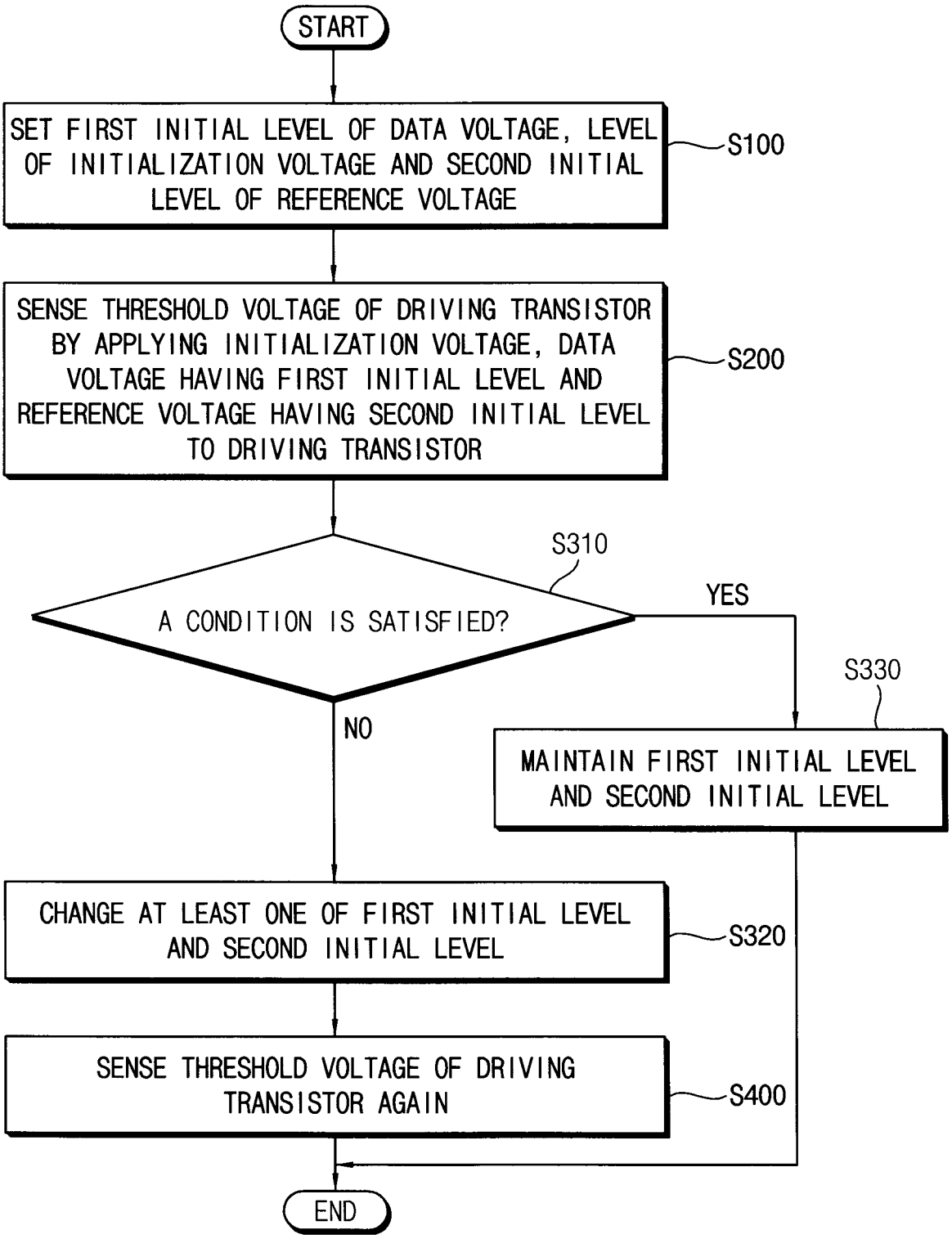
FIG. 1 is a flowchart illustrating a method of sensing a threshold voltage in a display panel according to example embodiments.

Various example embodiments will be described more fully with reference to the accompanying drawings, in which embodiments are shown. The disclosure may, however, be embodied in many different forms and should not be construed as limited to the embodiments set forth herein. Like reference numerals refer to like elements throughout this application.

FIG. 1 is a flowchart illustrating a method of sensing a threshold voltage in a display panel according to example embodiments.

Referring to FIG. 1, according to an example embodiment, a method of sensing a threshold voltage is performed by a display driver integrated (DDI) circuit that drives a display panel including a plurality of pixels each of which includes a driving transistor. A detailed configuration of a display device including the display panel and the display driver integrated circuit will be described with reference to FIGS. 2 and 3.

According to example embodiments, the method of sensing the threshold voltage in the display panel includes setting a first initial level of a data voltage, a level of an initialization voltage and a second initial level of a reference voltage (S100). The reference voltage is different from the initialization voltage.

The data voltage is a voltage applied to the driving transistor to drive the display panel in various ways such as displaying an image on the display panel. Particularly, the data voltage having the first initial level is used for sensing the threshold voltage of the driving transistor. Also, the initialization voltage and the reference voltage are voltages applied to the driving transistor to sense the threshold voltage of the driving transistor. The initialization voltage and the reference voltage are used only for sensing the threshold voltage of the driving transistor. As will be described later, the initialization voltage may have a fixed level, and at least one of the data voltage and the reference voltage may have a level that is selectively and dynamically changed according to variation in the threshold voltage.

In one or more example embodiments, an operation of setting the first initial level, setting the level of the initialization voltage and setting the second initial level in S100 may be performed when the display device including the display panel and the display driver integrated circuit is manufactured. For example, S100 may be performed once by an external test device and/or design device at the time of manufacturing the display device, and the first initial level, the level of the initialization voltage and the second initial level may be set and stored. After the storing operation, an operation of loading the first initial level, the level of the initialization voltage and the second initial level already stored in a memory or storage may be performed in S100, instead of setting the first initial level, the level of the initialization voltage and the second initial level. In this example, operations S200, S310, S210, S330 and S400 may be performed by loading the stored first initial level, the stored level of the initialization voltage and the stored second initial level.

The threshold voltage of the driving transistor is sensed by applying the initialization voltage, the data voltage having the first initial level and the reference voltage having the second initial level to the driving transistor (S200). For example, the data voltage may be applied to a gate electrode of the driving transistor, and the initialization voltage and the reference voltage are applied to a source electrode of the driving transistor. For example, as will be described with reference to FIGS. 6A and 6B, the threshold voltage of the driving transistor may be sensed or detected by sensing that the source electrode of the driving transistor is charged and settled to a voltage corresponding to a difference between a voltage of the gate electrode and the threshold voltage.

At least one of a level of the data voltage and a level of the reference voltage used for sensing the threshold voltage of the driving transistor may be selectively and dynamically changed according to whether the threshold voltage of the driving transistor varies and the degree of variation.

For example, when a condition is not satisfied by the variation in the threshold voltage of the driving transistor (S310: NO), at least one of the first initial level of the data voltage and the second initial level of the reference voltage is changed (S320), and the threshold voltage of the driving transistor is sensed again based on a result of changing at least one of the first initial level and the second initial level (S400). According to an embodiment, the condition may be predetermined condition. A detailed operation of S320 and corresponding S400 will be described with reference to FIGS. 4 through 10.

When the condition is satisfied (S310: YES), the first initial level of the data voltage and the second initial level of the reference voltage may be maintained (S330), and it may be determined that the threshold voltage of the driving transistor sensed in S200 has a normal level, and thus an additional sensing operation may not be performed. According to an embodiment, the condition may be satisfied in a case where the threshold voltage of the driving transistor does not vary and is maintained or even if the threshold voltage of the driving transistor varies and the threshold voltage of the driving transistor is maintained.

In one or more example embodiments, operations S100, S200, S310, S210, S330 and S400 may be performed during a threshold voltage sensing mode that is different from a display mode in which an image is displayed in the display panel. For example, the display device may enter the threshold voltage sensing mode immediately after the display device is powered on (or turned on) and before the display mode begins, or immediately after a power-off request is received at an end of the display mode and before the display device is actually powered off, and may perform the above-described operations.

An electroluminescent display panel, which includes a light emitting element such as a light-emitting diode (LED) or an organic light-emitting diode (OLED) and a driving transistor for driving the light emitting element, may have a problem of luminance variation due to deviation between light emitting elements, deviation between driving transistors, deterioration of the light emitting element and/or driving transistor, and the like. Such luminance variation may be reduced by compensating the threshold voltage of the driving transistor inside or outside the display panel. It is possible to directly measure and compensate the luminance variation of pixels while the display device is manufactured. However, to compensate the deterioration of the light emitting element over usage time after the display device is delivered to an end user, it may be necessary to continuously sense or detect the degree of direct deterioration.

According to example embodiments, in the method of sensing the threshold voltage in the display panel, the data voltage and the initialization voltage having a fixed level may be used for sensing the threshold voltage of the driving transistor, and the reference voltage different and distinguished from the initialization voltage may be further used for sensing the threshold voltage of the driving transistor. At least one of the data voltage and the reference voltage may have the level that is dynamically changed according to the variation in the threshold voltage. Thus, an operation of dynamically adjusting an initial charging voltage level of the driving transistor may be implemented by charging the driving transistor from near a voltage level to be sensed, rather than charging the driving transistor from a fixed voltage level. Accordingly, a charging time of the driving transistor and a sensing time of the threshold voltage of the driving transistor may be minimized, and the threshold voltage may be effectively sensed or detected.

Figure 2:
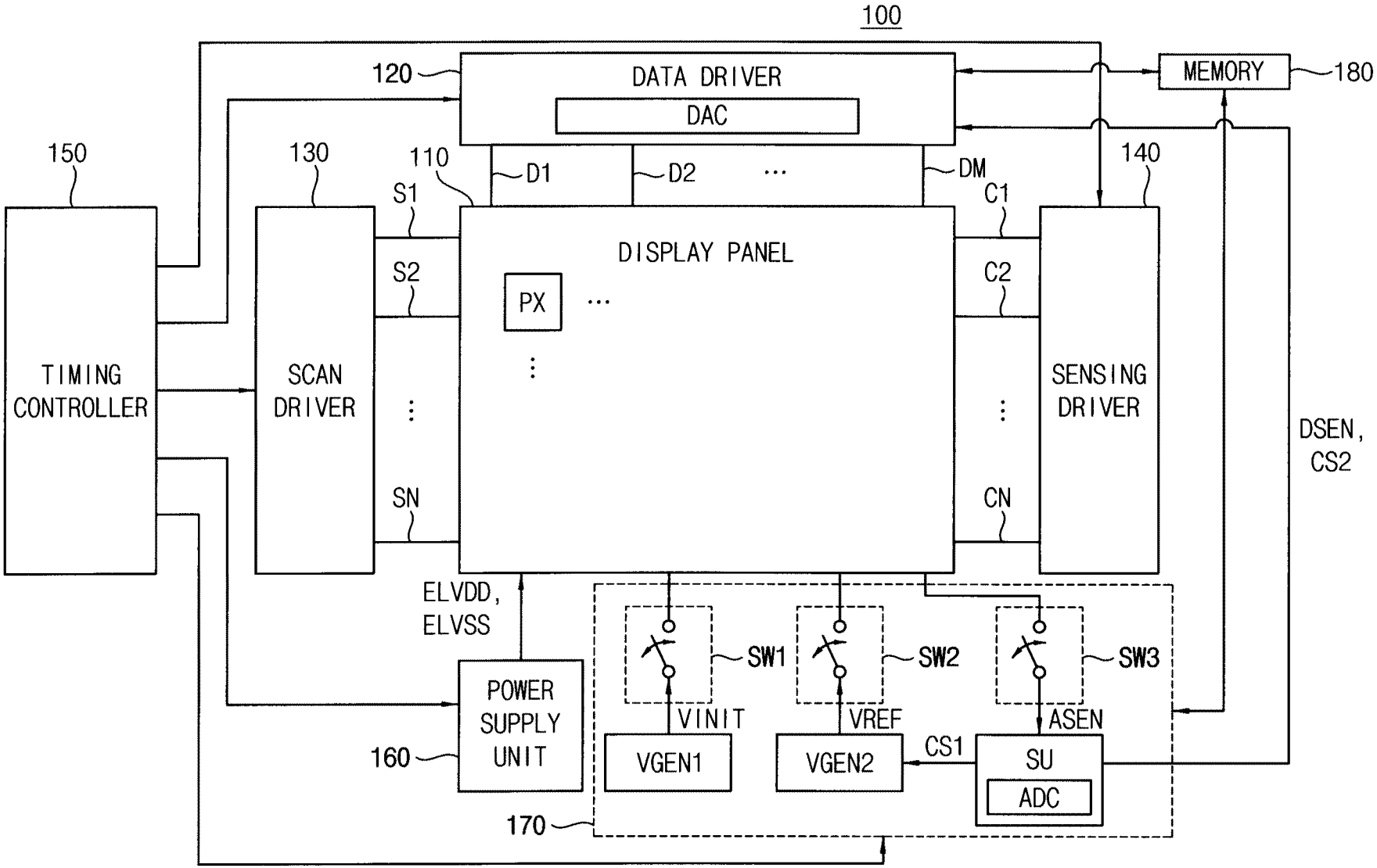
FIG. 2 is a block diagram illustrating a display driver integrated circuit and a display device including the display driver integrated circuit according to example embodiments.

FIG. 2 is a block diagram illustrating a display driver integrated circuit and a display device including the display driver integrated circuit according to example embodiments.

Referring to FIG. 2, a display device 100 includes a display panel 110 and a display driver integrated circuit. The display driver integrated circuit may include a data driver 120, a scan driver 130, a sensing driver 140, a timing controller 150, a power supply unit 160, a sensing block 170 and a memory 180. In other words, elements other than the display panel 110 among all elements illustrated in FIG. 2 may form the display driver integrated circuit.

The display panel 110 operates based on a data signal. For instance, the display panel 110 displays an image based on the data signal. The display panel 110 may be connected to the data driver 120 through a plurality of data lines D1, D2, . . . , DM. Further, the display panel 110 may be connected to the scan driver 130 through a plurality of scan lines S1, S2, . . . , SN. Also, the display panel 110 may be connected to the sensing driver 140 through a plurality of sensing control lines C1, C2, . . . , CN. The plurality of data lines D1, D2, . . . , DM may extend in a first direction, and the plurality of scan lines S1, S2, . . . , SN and the plurality of sensing control lines C1, C2, . . . , CN may extend in a second direction. According to an example embodiment, the second direction crosses the first direction. According to an example embodiment, the second direction is perpendicular or substantially perpendicular to the first direction.

The display panel 110 may include a plurality of pixels PX arranged in a matrix having a plurality of rows and a plurality of columns. As will be described with reference to FIG. 3, each of the plurality of pixels PX may include a light emitting element and a driving transistor for driving the light emitting element. Each of the plurality of pixels PX may be electrically connected to a respective one of the plurality of data lines D1, D2, . . . , DM, a respective one of the plurality of scan lines S1, S2, . . . , SN and a respective one of the plurality of sensing control lines C1, C2, . . . , CN.

In one or more example embodiments, the display panel 110 may be a self-emitting display panel that emits light without the use of a backlight unit. For example, the display panel 110 may be an organic light-emitting diode (OLED) display panel including an OLED as the light emitting element.

In one or more example embodiments, each of the plurality of pixels PX included in the display panel 110 may have various configurations according to a driving scheme of the display device 100. For example, the display device 100 may be driven with an analog or a digital driving scheme. While the analog driving scheme produces grayscale using variable voltage levels corresponding to input data, the digital driving scheme produces grayscale using variable time duration in which the LED emits light. The analog driving scheme is difficult to implement because it requires a driving integrated circuit (IC) that is complicated to manufacture if the display is large and has high resolution. On the other hand, the digital driving scheme can readily accomplish the required high resolution through a simpler IC structure. An example structure of each pixel PX will be described with reference to FIG. 3.

The data driver 120 may apply a plurality of data voltages to the display panel 110 through the plurality of data lines D1, D2, . . . , DM. The data driver 120 may include a digital-to-analog converter (DAC) that converts the data signal in a digital form into the data voltage in an analog form. The data voltage may have a driving level in a display mode in which the display panel 110 displays an image, and may have a level that is selectively and dynamically changed in a threshold voltage sensing mode for sensing a threshold voltage of the driving transistor included in each pixel PX.

The scan driver 130 may apply a plurality of scan signals to the display panel 110 through the plurality of scan lines S1, S2, . . . , SN. The plurality of scan lines S1, S2, . . . , SN may be sequentially activated based on the scan signal.

The sensing driver 140 may apply a plurality of sensing control signals to the display panel 110 through the plurality of sensing control lines C1, C2, . . . , CN, and may control an operation of sensing the threshold voltage of the driving transistor included in each pixel PX. For example, the pixel PX and the driving transistor included in the respective pixel PX for the operation of sensing the threshold voltage may be selected based on the sensing control signal.

The timing controller 150 may control overall operations of the display device 100. For example, the timing controller 150 may provide control signals to the data driver 120, the scan driver 130, the sensing driver 140, the power supply unit 160 and the sensing block 170 to control the operations of the display device 100. The control signals may be predetermined control signals.

In one or more example embodiments, the data driver 120, the scan driver 130 and the timing controller 150 may be implemented as one integrated circuit (IC). In other example embodiments, the data driver 120, the scan driver 130 and the timing controller 150 may be implemented as two or more integrated circuits. A driving module including at least the timing controller 150 and the data driver 120 may be referred to as a timing controller embedded data driver (TED).

The timing controller 150 may receive input image data and input control signals from an external host device, and may generate the data signal based on the input image data. For example, the input image data may include red image data, green image data and blue image data. Also, the input image data may include white image data. According to another example, the input image data may include magenta image data, yellow image data, cyan image data, and so on. The input control signals may include a master clock signal, a data enable signal, a horizontal synchronization signal, a vertical synchronization signal, and so on.

The power supply unit 160 may supply the display panel 110 with a first power supply voltage ELVDD and a second power supply voltage ELVSS. For example, the first power supply voltage ELVDD may be a high power supply voltage, and the second power supply voltage ELVSS may be a low power supply voltage.

The sensing block 170 performs the method of sensing the threshold voltage according to example embodiments described with reference to FIG. 1. The sensing block 170 may include a first voltage generator VGEN1, a second voltage generator VGEN2, a sensing circuit SU, a first switch SW1, a second switch SW2 and a third switch SW3.

The first voltage generator VGEN1 generates an initialization voltage VINIT that is used for sensing the threshold voltage of the driving transistor included in each pixel PX. The initialization voltage VINIT may have a fixed level.

The second voltage generator VGEN2 generates a reference voltage VREF that is used for sensing the threshold voltage of the driving transistor. The reference voltage VREF is different from the initialization voltage VINIT. The reference voltage VREF may have a level that is selectively and dynamically changed.

The sensing circuit SU senses the threshold voltage of the driving transistor when the initialization voltage VINIT, the data voltage having a first initial level and the reference voltage VREF having a second initial level are applied to the driving transistor during the threshold voltage sensing mode, generates at least one of control signals CS1 and CS2 for changing at least one of the first initial level and the second initial level when a condition is not satisfied by variation in the threshold voltage of the driving transistor, and senses the threshold voltage of the driving transistor again based on a result of changing at least one of the first initial level and the second initial level. According to an embodiment, the condition is predetermined. For example, the sensing circuit SU may include an analog-to-digital converter ADC that converts an analog sensing value ASEN associated with the sensed threshold voltage of the driving transistor into a digital sensing value DSEN.

According to example embodiments, when the condition is not satisfied by the variation in the threshold voltage of the driving transistor, the sensing circuit SU may generate the first control signal CS1 for adjusting the second initial level of the reference voltage VREF to provide the first control signal CS1 to the second voltage generator VGEN2, or may generate the second control signal CS2 for adjusting the first initial level of the data voltage to provide the second control signal CS2 to the data driver 120.

In the example of FIG. 2, the digital sensing value DSEN generated by the sensing circuit SU may be provided to the data driver 120. The data driver 120 may adjust, based on the digital sensing value DSEN, the driving level of the data voltage that is used for driving each pixel PX to display an image.

The first switch SW1 may be disposed between the first voltage generator VGEN1 and the driving transistor included in the pixel PX, and may control a timing of applying the initialization voltage VINIT. The second switch SW2 may be disposed between the second voltage generator VGEN2 and the driving transistor included in the pixel PX, and may control a timing of applying the reference voltage VREF. The third switch SW3 may be disposed between the sensing circuit SU and the driving transistor included in the pixel PX, and may control a timing of sensing the threshold voltage of the driving transistor included in the pixel PX. For example, each of the first, second and third switches SW1, SW2 and SW3 may include at least one transistor, and may be turned on or off based on a control of the timing controller 150.

According to an embodiment, the first, second and third switches SW1, SW2 and SW3 illustrated in FIG. 2 may be included in the display driving integrated circuit. In other words, the first, second and third switches SW1, SW2 and SW3 in FIG. 2 may be disposed at an IC-side.

For convenience of illustration, although one first voltage generator VGEN1, one second voltage generator VGEN2, one sensing circuit SU and three switches SW1, SW2 and SW3 connected thereto are illustrated in FIG. 2, example embodiments are not limited thereto, and the sensing block 170 may include a plurality of first voltage generators, a plurality of second voltage generators and a plurality of sensing circuits. For example, the number of the plurality of first voltage generators, the number of the plurality of second voltage generators and the number of the plurality of sensing circuits may be substantially equal to the number of the plurality of data lines D1, D2, . . . , DM, and pixels arranged in one pixel row may be connected to different first voltage generators, different second voltage generators and different sensing circuits to perform the operation of sensing the threshold voltage. For another example, the number of the plurality of first voltage generators, the number of the plurality of second voltage generators and the number of the plurality of sensing circuits may be less than the number of the plurality of data lines D1, D2, . . . , DM, and pixels adjacent to each other arranged in one pixel row may share one first voltage generator, one second voltage generator and one sensing circuit to perform the operation of sensing the threshold voltage.

For convenience of illustration, although the data driver 120 and the sensing block 170 are illustrated as separate elements in FIG. 2, example embodiments are not limited thereto, and the data driver 120 may be implemented to include the sensing block 170.

The memory 180 may store the first initial level of the data voltage, the level of the initialization voltage VINIT and the second initial level of the reference voltage VREF that are used for sensing the threshold voltage of the driving transistor. Further the memory 180 may store the sensed threshold voltage, and the memory 180 may store other data required for the operations of the display device 100.

In one or more example embodiments, the memory 180 may include at least one of various volatile memories such as a dynamic random access memory (DRAM), a static random access memory (SRAM), or the like, and/or at least one of various nonvolatile memories such as a flash memory, a phase change random access memory (PRAM), a resistance random access memory (RRAM), a magnetic random access memory (MRAM), a ferroelectric random access memory (FRAM), a nano floating gate memory (NFGM), a polymer random access memory (PoRAM), or the like.

In one or more example embodiments, at least some of the elements included in the display driver integrated circuit may be disposed, e.g., directly mounted, on the display panel 110, or may be connected to the display panel 110 in a tape carrier package (TCP) type. Alternatively, at least some of the elements included in the display driver integrated circuit may be integrated on the display panel 110. In one or more example embodiments, the elements included in the display driver integrated circuit may be respectively implemented with separate circuits/modules/chips. In other example embodiments, on the basis of a function, some of the elements included in the display driver integrated circuit may be combined into one circuit/module/chip, or may be further separated into a plurality of circuits/modules/chips.

Figure 3:
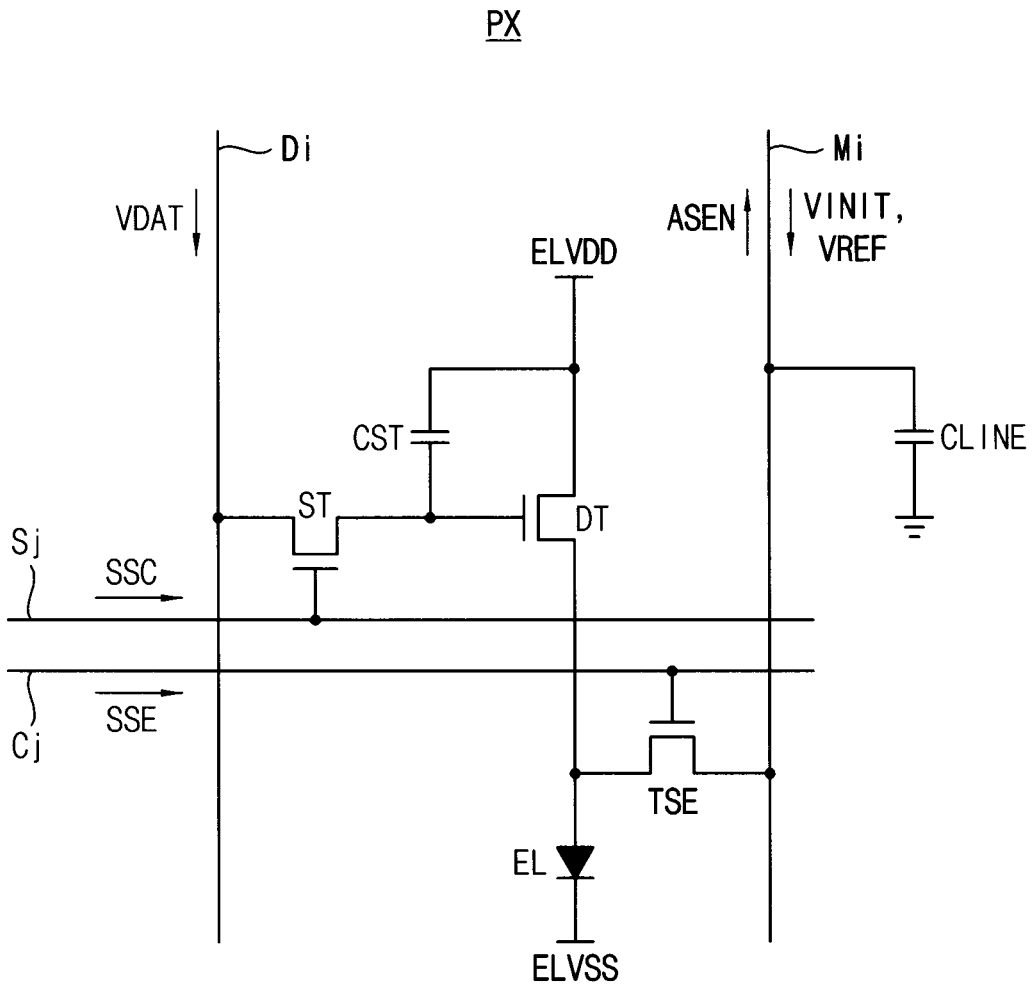
FIG. 3 is a circuit diagram illustrating an example of a pixel included in a display panel in the display device of FIG. 2.

FIG. 3 is a circuit diagram illustrating an example of a pixel included in a display panel in the display device of FIG. 2.

Referring to FIG. 3, each pixel PX may include a switching transistor ST, a storage capacitor CST, a driving transistor DT, a sensing transistor TSE, an organic light-emitting diode EL and a line capacitor CLINE.

The switching transistor ST may have a first electrode connected to a data line Di, a second electrode connected to the storage capacitor CST, and a gate electrode connected to a scan line Sj. The switching transistor ST may transfer a data voltage VDAT received from the data driver 120 to the storage capacitor CST in response to a scan signal SSC received from the scan driver 130 on the scan line Sj.

The storage capacitor CST may have a first electrode connected to the first power supply voltage ELVDD and a second electrode connected to a gate electrode of the driving transistor DT. The storage capacitor CST may store the data voltage VDAT transferred through the switching transistor ST.

The driving transistor DT may have a first electrode connected to the first power supply voltage ELVDD, a second electrode connected to the organic light-emitting diode EL, and the gate electrode connected to the storage capacitor CST. The driving transistor DT may be turned on or off according to the data voltage VDAT stored in the storage capacitor CST.

The organic light-emitting diode EL may have an anode electrode connected to the driving transistor DT and a cathode electrode connected to the second power supply voltage ELVSS. The organic light-emitting diode EL may emit light based on a current flowing from the first power supply voltage ELVDD to the second power supply voltage ELVSS while the driving transistor DT is turned on. The brightness of the pixel PX may increase as the current flowing through the organic light-emitting diode EL increases.

The sensing transistor TSE may have a first electrode connected to the organic light-emitting diode EL, a gate electrode connected to a sensing control line Cj, and a second electrode connected to a sensing line Mi and the line capacitor CLINE. The sensing transistor TSE may transfer the initialization voltage VINIT and the reference voltage VREF to the second electrode of the driving transistor DT in response to a sensing control signal SSE received from the sensing driver 140, or may output the analog sensing value ASEN associated with a threshold voltage of the driving transistor DT sensed from the second electrode of the driving transistor DT.

Unlike the storage capacitor CST, the line capacitor CLINE may be a parasitic capacitor formed between the sensing line Mi and a ground voltage. The second electrode of the driving transistor DT may be charged during the threshold voltage sensing mode by the line capacitor CLINE, the initialization voltage VINIT and the reference voltage VREF.

Although FIG. 3 illustrates an OLED pixel as an example of each pixel PX that may be included in the display panel 110, it would be understood that example embodiments are not limited to the OLED pixel and example embodiment may be applied to any pixels of various types and configurations.

Figure 4:
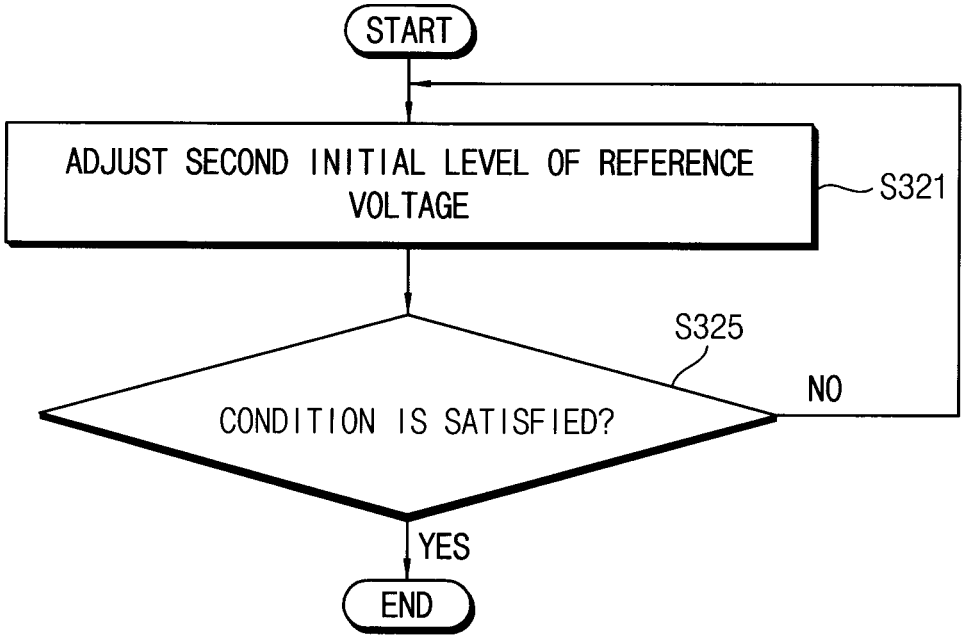
FIG. 4 is a flowchart illustrating an example of changing at least one of a first initial level and a second initial level in FIG. 1.

FIG. 4 is a flowchart illustrating an example of changing at least one of a first initial level and a second initial level in FIG. 1.

Referring to FIGS. 1 and 4, the changing at least one of the first initial level and the second initial level in S320 (when a condition is not satisfied in S310) may include adjusting the second initial level of the reference voltage (S321). If the condition is still not satisfied even after adjusting the second initial level (S325: NO), operation S321 may be performed again to re-adjust the second initial level. If the condition is satisfied after adjusting the second initial level (S325: YES), the operation of adjusting the second initial level may be terminated. The condition may be a predetermined condition. In other words, the second initial level may be adjusted until the predetermined condition is satisfied. FIG. 4 illustrates an example where only the second initial level is adjusted. According to another embodiment, the first initial level, or both the first initial level and the second level may be adjusted.

In one or more example embodiments, the predetermined condition may include a first condition where a charging time of the second electrode of the driving transistor DT to which the initialization voltage and the reference voltage are applied is greater than or equal to a first time. For example, the first condition may be a condition in which the charging time is ensured or guaranteed for more than or equal to the first time. According to an embodiment, the first time is predetermined. In other example embodiments, the predetermined condition may include a second condition where a charging voltage of the second electrode of the driving transistor to which the initialization voltage and the reference voltage are applied has a level greater than or equal to a predetermined first level. For example, the second condition may be a condition in which the charging voltage is ensured or guaranteed above or equal to the predetermined first level. In still other example embodiments, the predetermined condition may include both the first condition and the second condition.

FIGS. 5, 6A, 6B, 6C, 6D and 7 are diagrams for describing an operation of FIG. 4.

Figure 5:
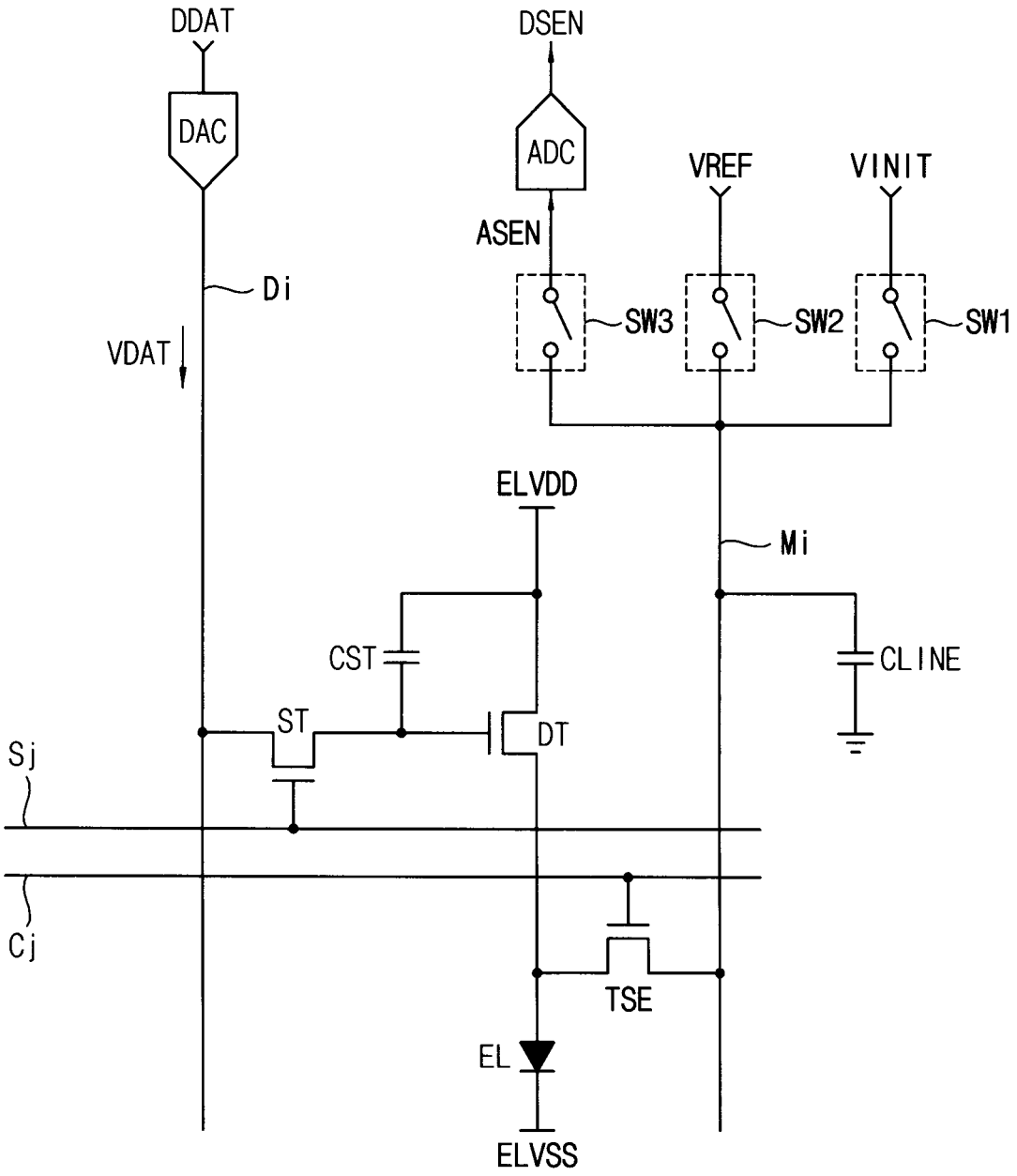
FIGS. 5, 6A, 6B, 6C, 6D and 7 are diagrams for describing an operation of FIG. 4.

Referring to FIG. 5, an example where the data voltage VDAT, the initialization voltage VINIT and the reference voltage VREF are applied to the pixel PX of FIG. 3, and the analog sensing value ASEN is obtained from the pixel PX of FIG. 3 is illustrated.

A digital-to-analog converter DAC included in the data driver 120 may convert data signal DDAT into the data voltage VDAT to provide the data voltage VDAT to the data line Di. The data voltage VDAT may be transferred to the gate electrode of the driving transistor DT and the storage capacitor CST through the switching transistor ST.

Referring to FIGS. 2 and 5, the first voltage generator VGEN1 may provide the initialization voltage VINIT to the sensing line Mi when the first switch SW1 is closed. The second voltage generator VGEN2 may provide the reference voltage VREF to the sensing line Mi when the second switch SW2 is closed. The initialization voltage VINIT and the reference voltage VREF may be transferred to the second electrode of the driving transistor DT and the line capacitor CLINE through the sensing transistor TSE. The second electrode may be a source electrode.

The sensing circuit SU may obtain the analog sensing value ASEN when the third switch SW3 is closed, and the analog-to-digital converter ADC included in the sensing circuit SU may convert the analog sensing value ASEN into the digital sensing value DSEN to output the digital sensing value DSEN.

In FIGS. 6A, 6B, 6C and 6D, VG represents a voltage or voltage level of the gate electrode of the driving transistor DT, and VS represents a voltage or voltage level of the second electrode of the driving transistor DT.

Figure 6A:
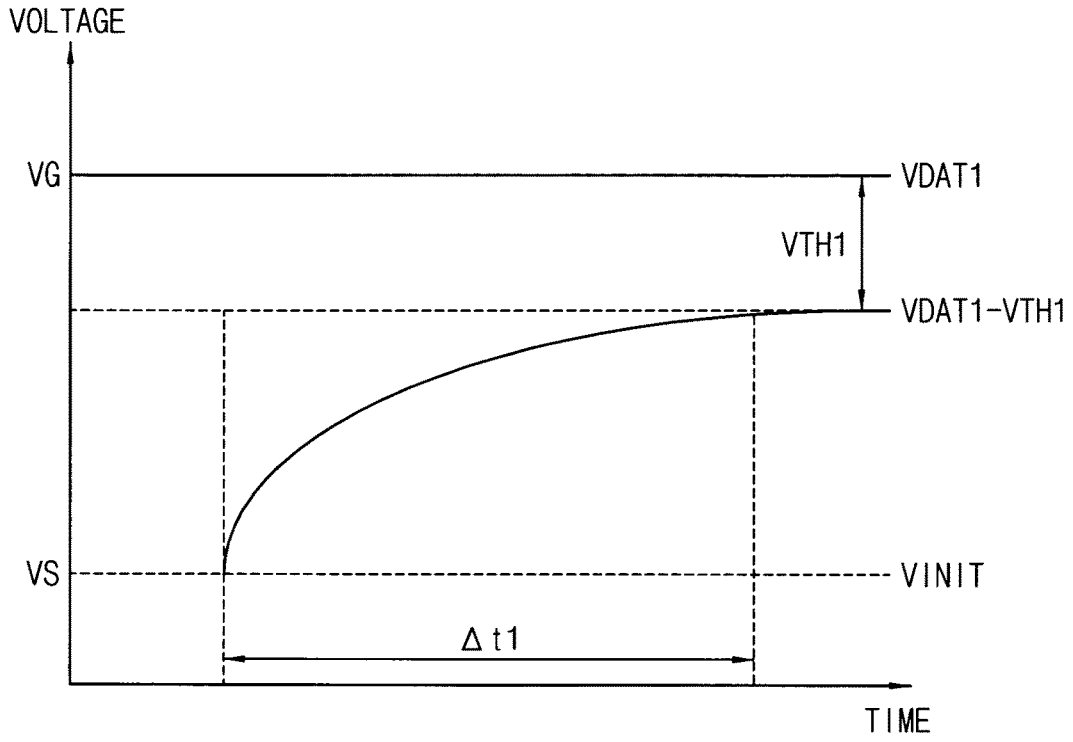

Referring to FIG. 6A, an example where the reference voltage VREF is not applied to the second electrode of the driving transistor DT is illustrated. During the threshold voltage sensing mode, the data voltage VDAT having a first initial level VDAT1 may be applied to the gate electrode of the driving transistor DT, and the initialization voltage VINIT having a fixed level may be applied to the second electrode of the driving transistor DT. For example, the first initial level VDAT1 may be higher than the level of the initialization voltage VINIT.

A threshold voltage VTH1 of the driving transistor DT may be sensed or detected by turning off the driving transistor DT and by sensing that the second electrode of the driving transistor DT is charged and stabilized at a voltage level VDAT1-VTH1 corresponding to a difference between the voltage of the gate electrode and the threshold voltage VTH1. Here voltage at the gate is the data voltage VDAT having the first initial level VDAT1. As illustrated in FIG. 6A, if the reference voltage VREF is not applied to the second electrode of the driving transistor DT, a time Δt1 required for charging and stabilizing the second electrode of the driving transistor DT may be relatively long.

Figure 6B:
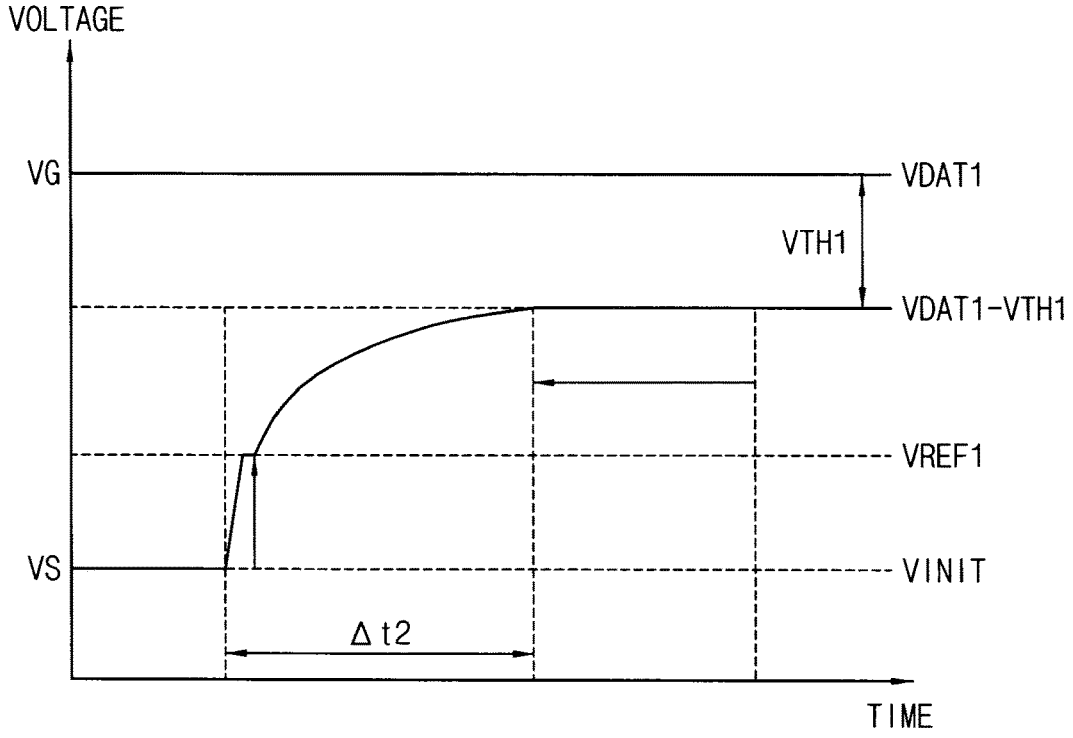

Referring to FIG. 6B, an example where the reference voltage VREF is applied to the second electrode of the driving transistor DT according to example embodiments is illustrated. During the threshold voltage sensing mode, the data voltage VDAT having the first initial level VDAT1 may be applied to the gate electrode of the driving transistor DT, the initialization voltage VINIT having the fixed level may be applied to the second electrode of the driving transistor DT, and the reference voltage VREF having a second initial level VREF1 may be additionally applied to the second electrode of the driving transistor DT. For example, the second initial level VREF1 may be lower than the first initial level VDAT1 and higher than the level of the initialization voltage VINIT.

As with the example of FIG. 6A, the threshold voltage VTH1 of the driving transistor DT may be sensed or detected by sensing that the second electrode of the driving transistor DT is charged and stabilized at the voltage level VDAT1-VTH1 in the example of FIG. 6B. However, unlike the example of FIG. 6A, a starting level for charging the second electrode of the driving transistor DT may not always be the level of the fixed initialization voltage VINIT, but may be the second initial level VREF1 that is higher than the level of the initialization voltage VINIT in the example of FIG. 6B. For instance, the second initial level VREF1 may be closer to the voltage level VDAT1-VTH1 to be sensed. Thus, compared with the example of FIG. 6A, a time Δt2 required for charging and stabilizing the second electrode of the driving transistor DT may be reduced in the example of FIG. 6B.

In one or more example embodiments, a voltage level VDAT1-VTH1-VREF1 obtained by subtracting a level of the threshold voltage VTH1 and the second initial level VREF1 from the first initial level VDAT1 may be obtained as the analog sensing value ASEN, and the voltage level VDAT1-VTH1-VREF1 may be analog-to-digital converted to obtain the digital sensing value DSEN.

Although FIG. 6B illustrates an example where the reference voltage VREF having the second initial level VREF1 is additionally applied to the second electrode of the driving transistor DT immediately after an operation of charging the second electrode of the driving transistor DT begins, example embodiments are not limited thereto, and the reference voltage VREF may be applied at any time before or after the operation of charging the second electrode begins.

Figure 6C:
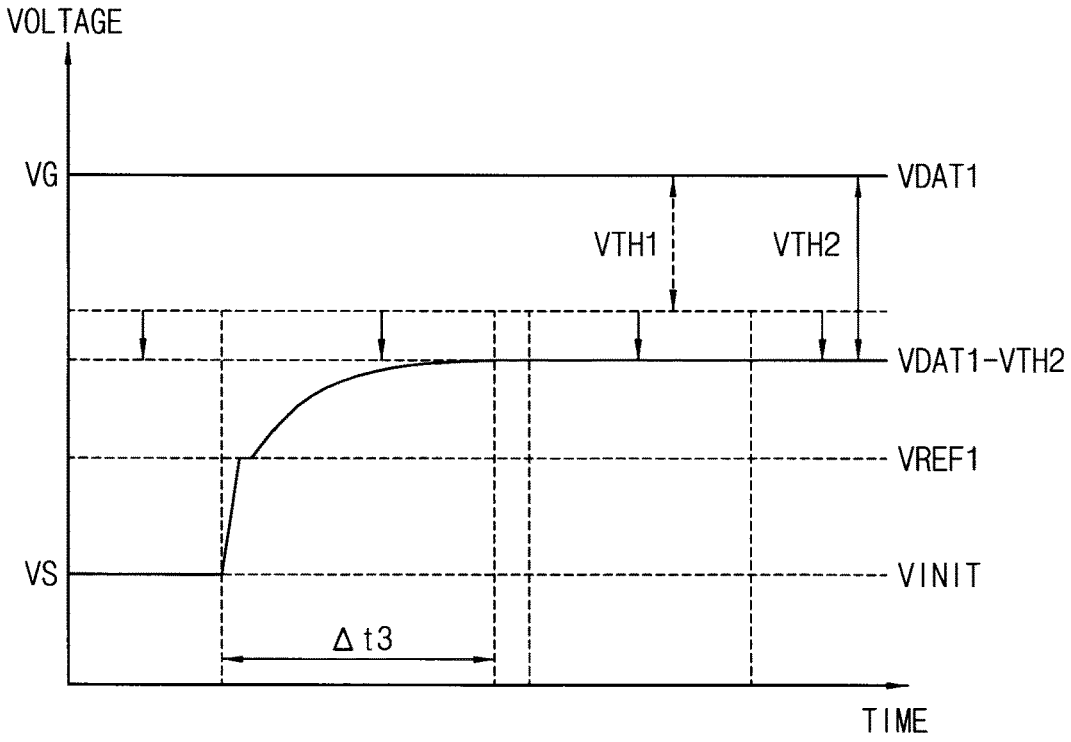

Referring to FIG. 6C, the threshold voltage of the driving transistor DT may vary from VTH1 to VTH2. For example, the varied threshold voltage VTH2 of the driving transistor DT may be greater than the initial threshold voltage VTH1. In other words, the threshold voltage of the driving transistor DT may increase.

When the threshold voltage of the driving transistor DT increases, the predetermined condition may not be satisfied. For example, as illustrated in FIG. 6C, a charging time Δt3 of the second electrode of the driving transistor DT may be reduced to be shorter than the time Δt2 in FIG. 6B, and thus the first condition described with reference to FIG. 4 may not be satisfied. For another example, as illustrated in FIG. 6C, a level of a charging voltage VDAT1-VTH2-VREF1 of the second electrode of the driving transistor DT may be reduced to be smaller than the voltage level VDAT1-VTH1-VREF1 in FIG. 6B, and thus the second condition described with reference to FIG. 4 may not be satisfied.

In one or more example embodiments, it may be determined whether the predetermined condition is satisfied based on the analog sensing value ASEN and the digital sensing value DSEN. As described above, since the voltage level VDAT1-VTH1-VREF1 is obtained as the analog sensing value ASEN and the digital sensing value DSEN is obtained based on the analog sensing value ASEN, the analog sensing value ASEN may also be changed from VDAT1-VTH1-VREF1 to VDAT1-VTH2-VREF1 when the threshold voltage varies from VTH1 to VTH2. Thus, it may be determined based on the changed analog sensing value ASEN and the changed digital sensing value DSEN whether the first condition and/or the second condition are satisfied.

Figure 6D:
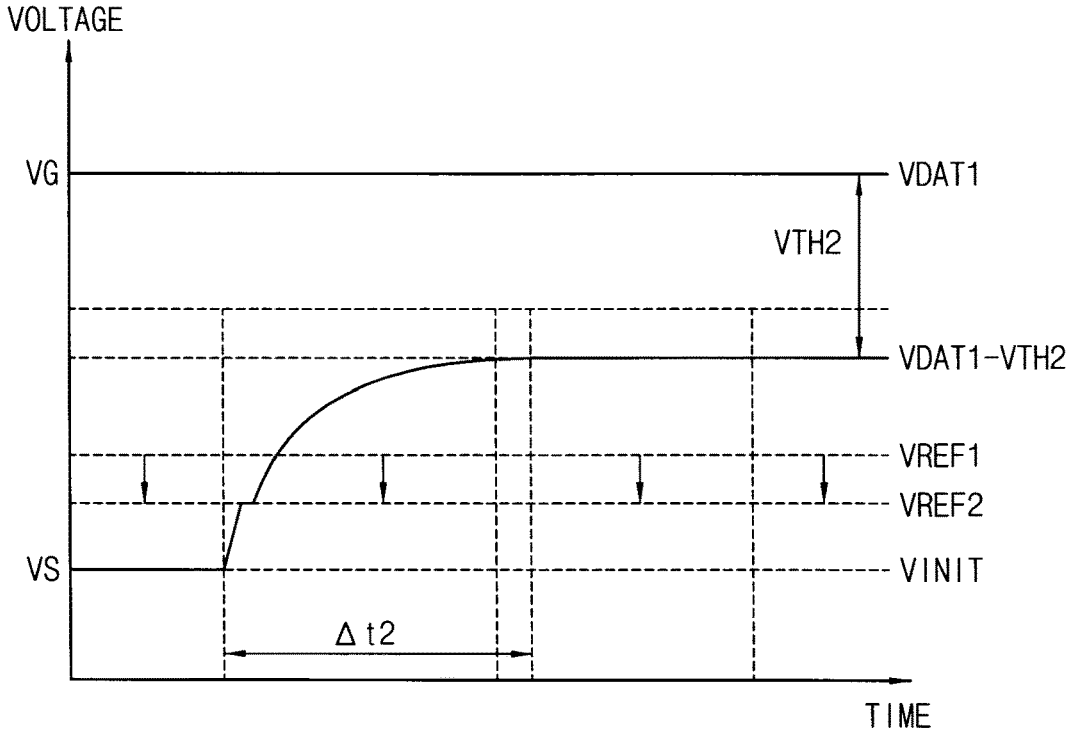

Referring to FIG. 6D, the second initial level VREF1 of the reference voltage VREF may be adjusted to sense the varied threshold voltage VTH2 of the driving transistor DT. For example, when the threshold voltage of the driving transistor DT varies from VTH1 to VTH2, the second initial level of the reference voltage VREF may be adjusted from VREF1 to VREF2. In other words, when the threshold voltage of the driving transistor DT increases, the second initial level of the reference voltage VREF may decrease.

When the second initial level of the reference voltage VREF decreases as the threshold voltage of the driving transistor DT increases, the predetermined condition may be satisfied again. For example, as illustrated in FIG. 6D, a charging time Δt2 of the second electrode of the driving transistor DT may be substantially the same as the time Δt2 in FIG. 6B, and thus the first condition described with reference to FIG. 4 may be satisfied again. For another example, as illustrated in FIG. 6D, a level of a charging voltage VDAT1-VTH2-VREF2 of the second electrode of the driving transistor DT may be substantially the same as the charging voltage VDAT1-VTH1-VREF1 in FIG. 6B, and thus the second condition described with reference to FIG. 4 may be satisfied again.

In one or more example embodiments, a voltage level VDAT1-VTH2-VREF2 obtained by subtracting a level of the varied threshold voltage VTH2 and the changed second initial level VREF2 from the first initial level VDAT1 may be obtained as the analog sensing value ASEN, and the analog sensing value ASEN may be analog-to-digital converted to obtain the digital sensing value DSEN. The analog sensing value ASEN and the digital sensing value DSEN obtained from the example of FIG. 6D may be substantially the same as the analog sensing value ASEN and the digital sensing value DSEN obtained from the example of FIG. 6B, respectively.

Figure 7:
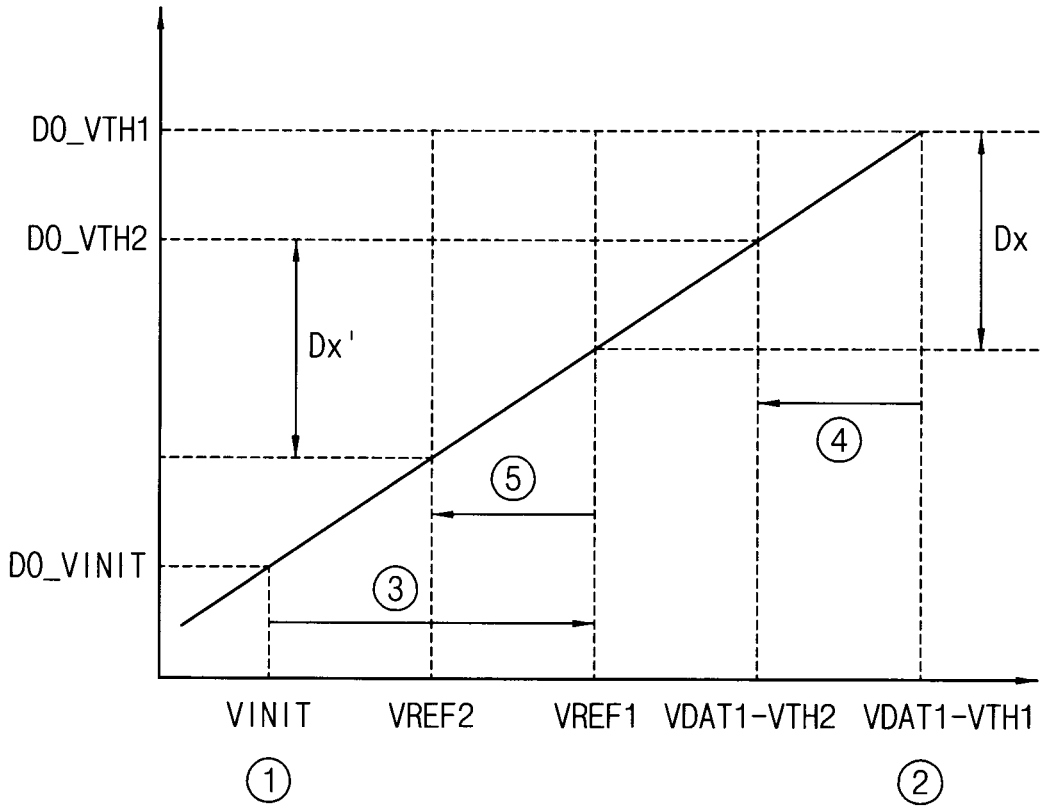

Referring to FIG. 7, the operations described with reference to FIGS. 6A, 6B, 6C and 6D are illustrated in one graph.

When only the initialization voltage VINIT is applied to the second electrode of the driving transistor DT, the second electrode may be charged to the voltage level VDAT1-VTH1 by the threshold voltage VTH1 of the driving transistor DT, and a value DO_VTH1-DO_VINIT may be output as the digital sensing value DSEN (e.g., ① and ② in FIG. 7).

When the initialization voltage VINIT and the reference voltage VREF are applied to the second electrode of the driving transistor DT, a time for charging the second electrode to the voltage level VDAT1-VTH1 may be reduced, and a value Dx may be output as the digital sensing value DSEN (e.g., ③ in FIG. 7).

When the threshold voltage of the driving transistor DT varies from VTH1 to VTH2, the second initial level of the reference voltage VREF may be adjusted from VREF1 to VREF2, the second electrode may be charged to the voltage level VDAT1-VTH2, and a value Dx' that is substantially equal to the value Dx may be output as the digital sensing value DSEN (e.g., ④ and ⑤ in FIG. 7).

As described above, the starting level of charging for sensing the threshold voltage may be set closer to the voltage level to be sensed based on the initialization voltage VINIT and the reference voltage VREF, and thus the charging time and the threshold voltage sensing time may be reduced. In addition, a dynamic control of the starting level of charging for sensing the threshold voltage may be employed by the operation of dynamically adjusting the level of the reference voltage VREF, and thus relatively fast threshold voltage sensing may be performed while the charging voltage and the charging time are guaranteed to a desired or target level.

Figure 8:
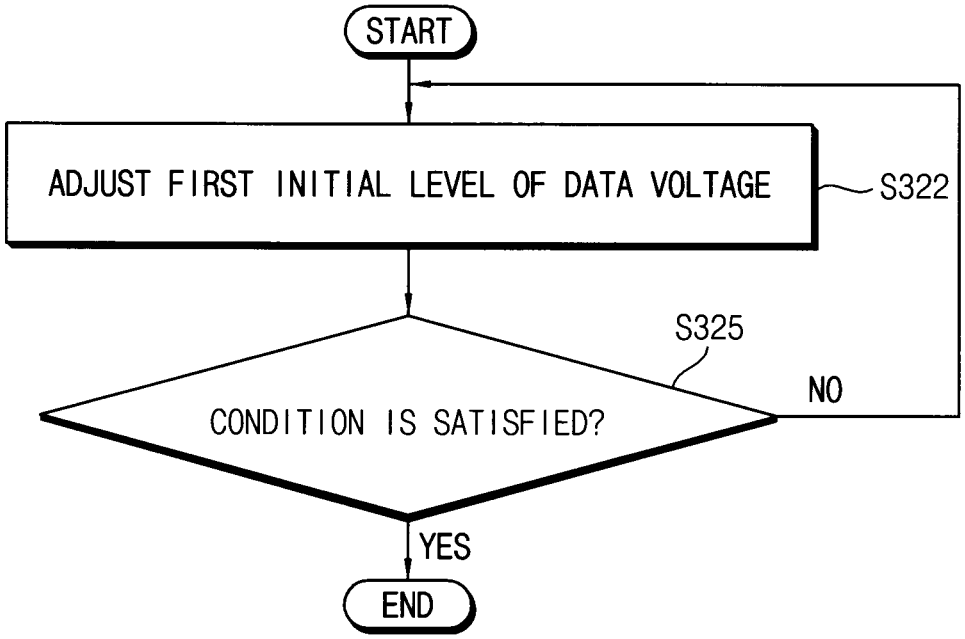
FIG. 8 is a flowchart illustrating another example of changing at least one of a first initial level and a second initial level in FIG. 1.

FIG. 8 is a flowchart illustrating another example of changing at least one of a first initial level and a second initial level in FIG. 1. The descriptions repeated with FIG. 4 will be omitted.

Referring to FIGS. 1 and 8, the changing at least one of the first initial level and the second initial level in S320 (i.e., when a condition is not satisfied in S310) may include adjusting the first initial level of the data voltage (S322). If the condition is still not satisfied even after adjusting the first initial level (S325: NO), operation S322 may be performed again to re-adjust the first initial level. If the predetermined condition is satisfied after adjusting the first initial level (S325: YES), the operation of adjusting the first initial level may be terminated. In other words, the first initial level may be adjusted until the predetermined condition is satisfied. FIG. 8 illustrates an example where only the first initial level is adjusted. According to another embodiment, the second initial level, or both the second initial level and the first level may be adjusted.

FIGS. 9A, 9B, 9C and 9D are diagrams for describing an operation of FIG. 8. The descriptions repeated with FIGS. 6A, 6B, 6C and 6D will be omitted.

Figure 9A:
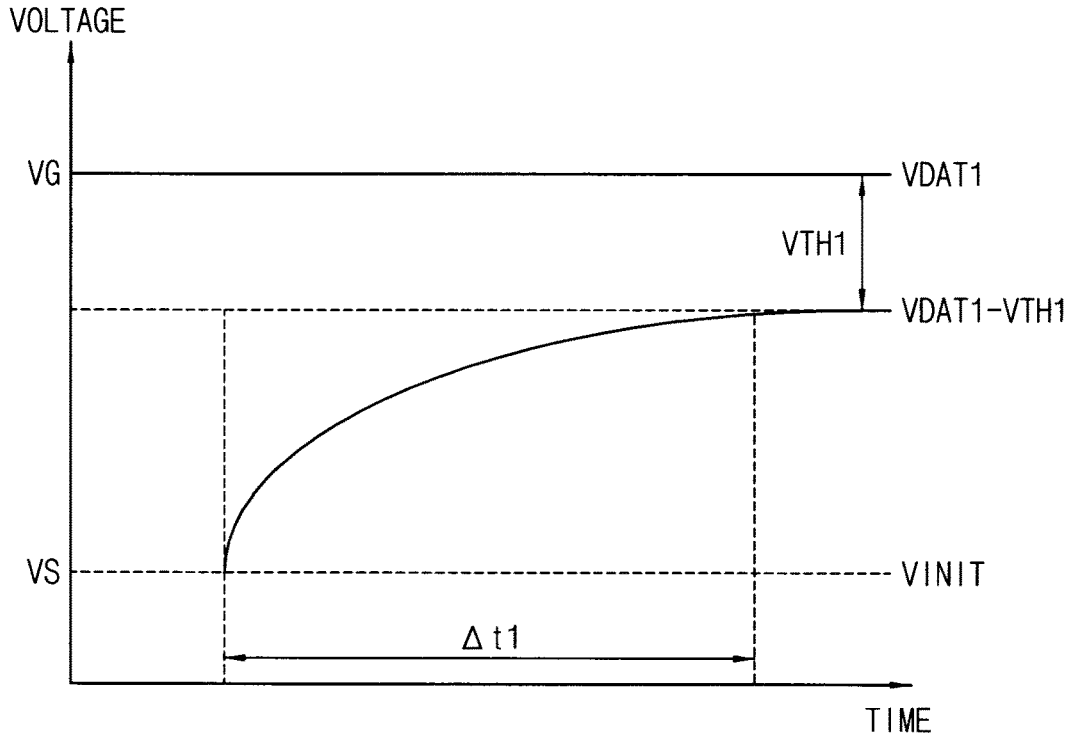
FIGS. 9A, 9B, 9C and 9D are diagrams for describing an operation of FIG. 8.

Referring to FIG. 9A, as with the example of FIG. 6A, the threshold voltage VTH1 of the driving transistor DT may be sensed or detected by applying only the data voltage VDAT having the first initial level VDAT1 and the initialization voltage VINIT to the driving transistor DT and by sensing that the second electrode of the driving transistor DT is charged and stabilized at the voltage level VDAT1-VTH1.

Figure 9B:
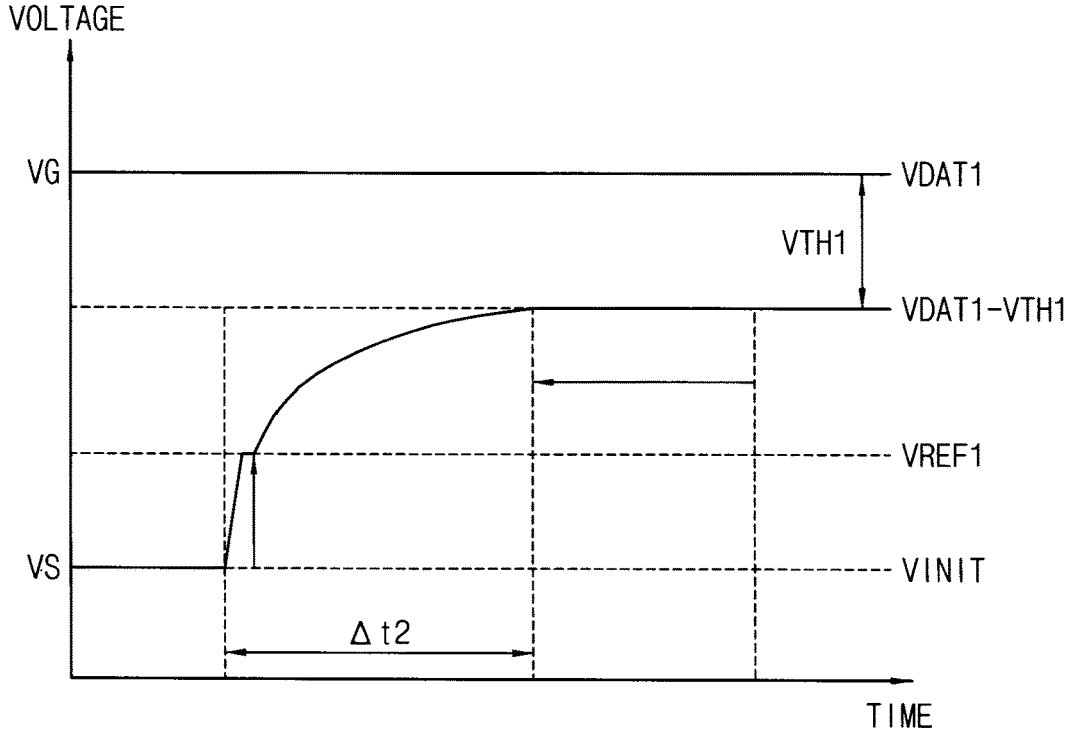

Referring to FIG. 9B, as with the example of FIG. 6B, the threshold voltage VTH1 of the driving transistor DT may be sensed more quickly by applying the data voltage VDAT having the first initial level VDAT1, the initialization voltage VINIT and the reference voltage VREF having the second initial level VREF1 to the driving transistor DT and by sensing that the second electrode of the driving transistor DT is charged and stabilized at the voltage level VDAT1-VTH1.

Figure 9C:
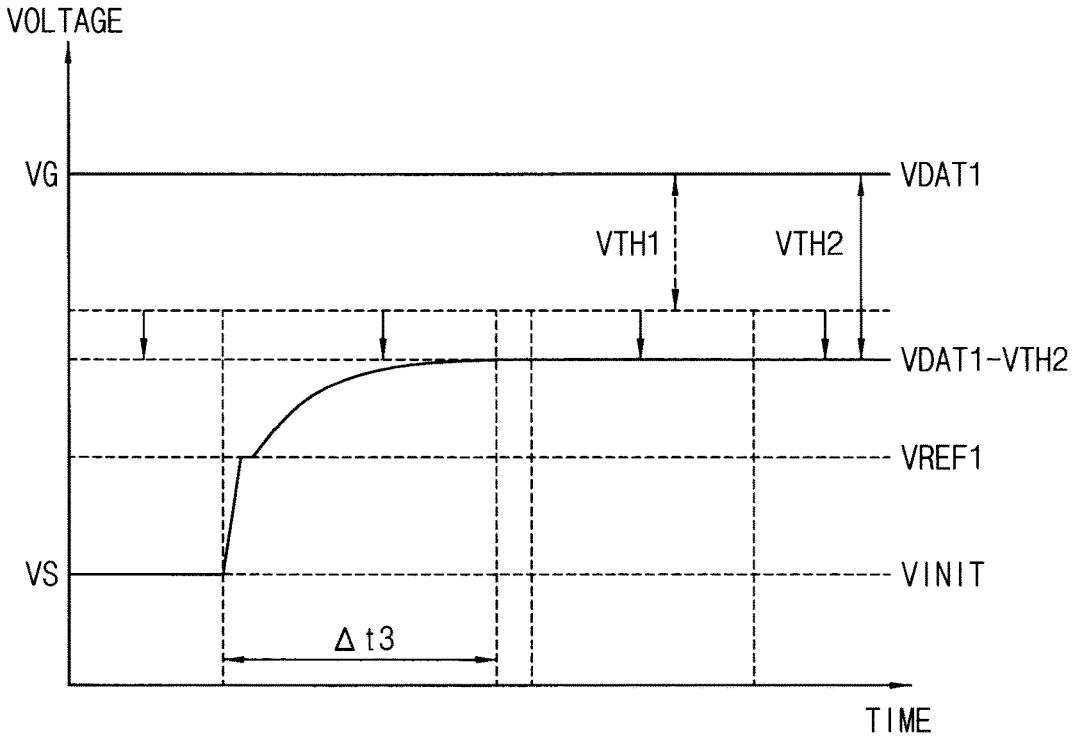

Referring to FIG. 9C, as with the example of FIG. 6C, the threshold voltage of the driving transistor DT may vary from VTH1 to VTH2, and thus the predetermined condition may not be satisfied.

Figure 9D:
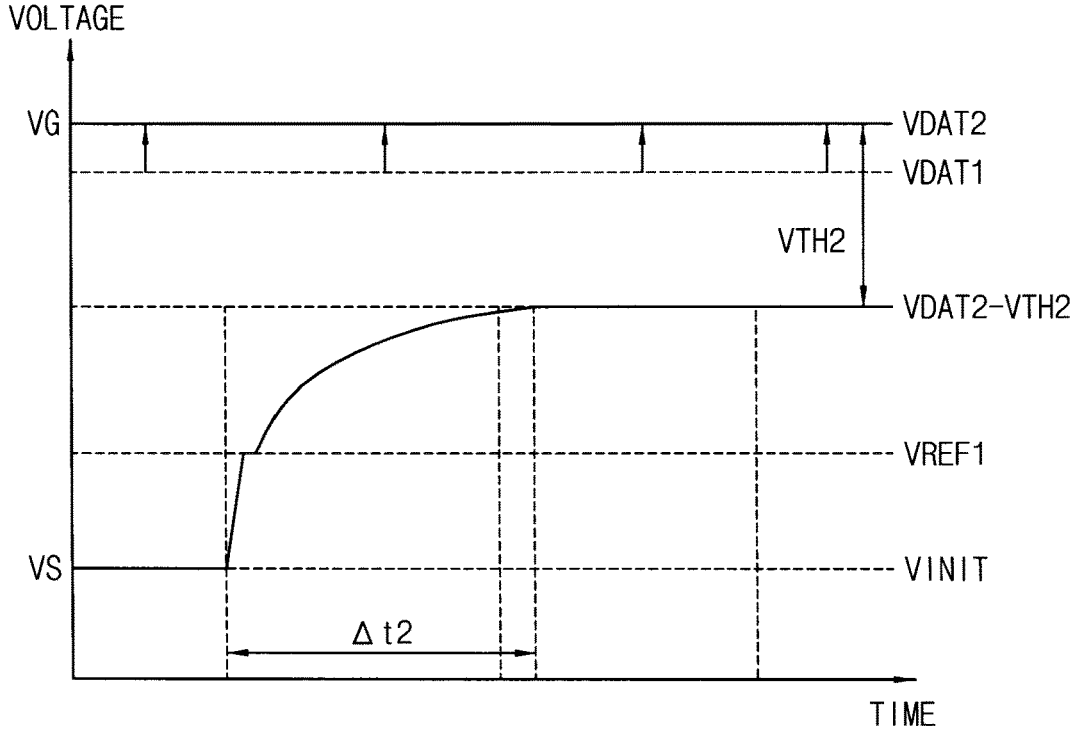

Referring to FIG. 9D, the first initial level VDAT1 of the data voltage VDAT may be adjusted to sense the varied threshold voltage VTH2 of the driving transistor DT. For example, when the threshold voltage of the driving transistor DT varies from VTH1 to VTH2, the first initial level of the data voltage VDAT may be adjusted from VDAT1 to VDAT2. In other words, when the threshold voltage of the driving transistor TD increases, the first initial level of the data voltage VDAT may increase.

When the first initial level of the data voltage VDAT increases as the threshold voltage of the driving transistor DT increases, the predetermined condition may be satisfied again. For example, as illustrated in FIG. 9D, a charging time Δt2 of the second electrode of the driving transistor DT may be substantially the same as the time Δt2 in FIG. 9B, and thus the first condition described with reference to FIG. 4 may be satisfied again. For another example, as illustrated in FIG. 9D, a level of a charging voltage VDAT2-VTH2-VREF1 of the second electrode of the driving transistor DT may be substantially the same as the charging voltage VDAT1-VTH1-VREF1 in FIG. 9B, and thus the second condition described with reference to FIG. 4 may be satisfied again.

In one or more example embodiments, a voltage level VDAT2-VTH2-VREF1 obtained by subtracting a level of the varied threshold voltage VTH2 and the second initial level VREF1 from the changed first initial level VDAT2 may be obtained as the analog sensing value ASEN, and the analog sensing value ASEN may be analog-to-digital converted to obtain the digital sensing value DSEN. The analog sensing value ASEN and the digital sensing value DSEN obtained from the example of FIG. 9D may be substantially the same as the analog sensing value ASEN and the digital sensing value DSEN obtained from the example of FIG. 9B, respectively.

As described above, the starting level of charging for sensing the threshold voltage may be set closer to the voltage level to be sensed based on the initialization voltage VINIT and the reference voltage VREF, and thus the charging time and the threshold voltage sensing time may be reduced. In addition, the operation of dynamically adjusting the level of the data voltage VDAT may be employed, and thus relatively fast threshold voltage sensing may be performed while the charging voltage and the charging time are guaranteed to a desired or target level.

Figure 10:
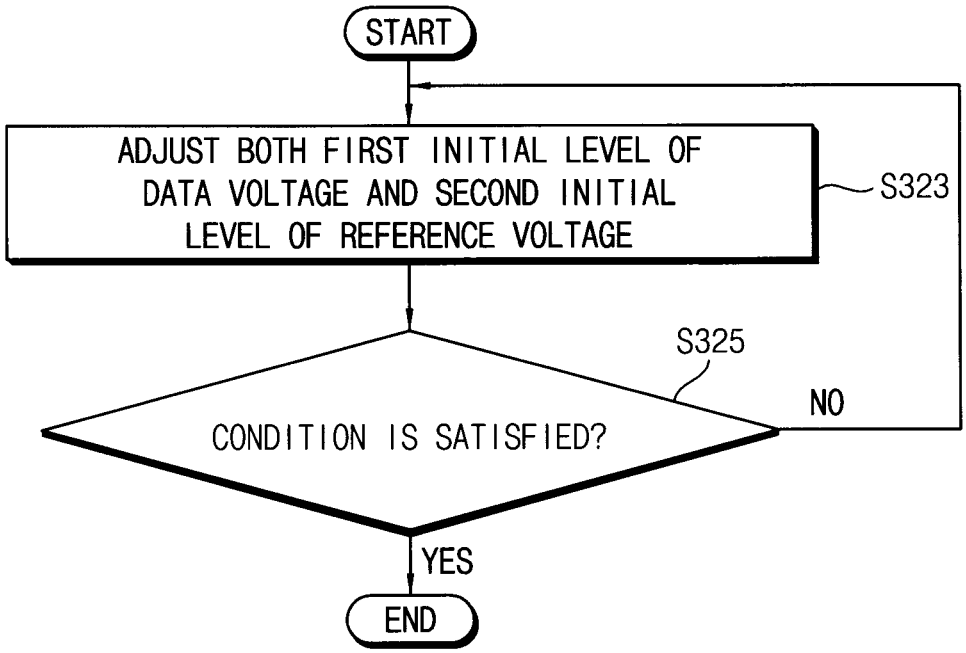
FIG. 10 is a flowchart illustrating yet another example of changing at least one of a first initial level and a second initial level in FIG. 1.

FIG. 10 is a flowchart illustrating still another example of changing at least one of a first initial level and a second initial level in FIG. 1. The descriptions repeated with FIGS. 4 and 8 will be omitted.

Referring to FIGS. 1 and 10, the changing at least one of the first initial level and the second initial level (S320) may include adjusting both the first initial level of the data voltage and the second initial level of the reference voltage (S323). If the predetermined condition is still not satisfied even after adjusting the first initial level and the second initial level (S325: NO), step S323 may be re-performed or performed again to re-adjust the first initial level and the second initial level. If the predetermined condition is satisfied after adjusting the first initial level and the second initial level (S325: YES), the operation of adjusting the first initial level and the second initial level may be terminated. In other words, the first initial level and the second initial level may be adjusted until the predetermined condition is satisfied. FIG. 10 illustrates an example where both the first initial level and the second initial level are adjusted. The operation of adjusting the second initial level may be substantially the same as described with reference to FIG. 4, and the operation of adjusting the first initial level may be substantially the same as described with reference to FIG. 8.

Although the operations of changing the first initial level and the second initial level are described with reference to FIGS. 4 through 10 based on the examples where each pixel PX includes n-type metal oxide semiconductor (NMOS) transistors and the threshold voltage of the driving transistor TD increases, example embodiments are not limited thereto, and example embodiments may be applied to examples where each pixel PX includes p-type metal oxide semiconductor (PMOS) transistors and/or the threshold voltage of the driving transistor TD decreases.

Figure 11:
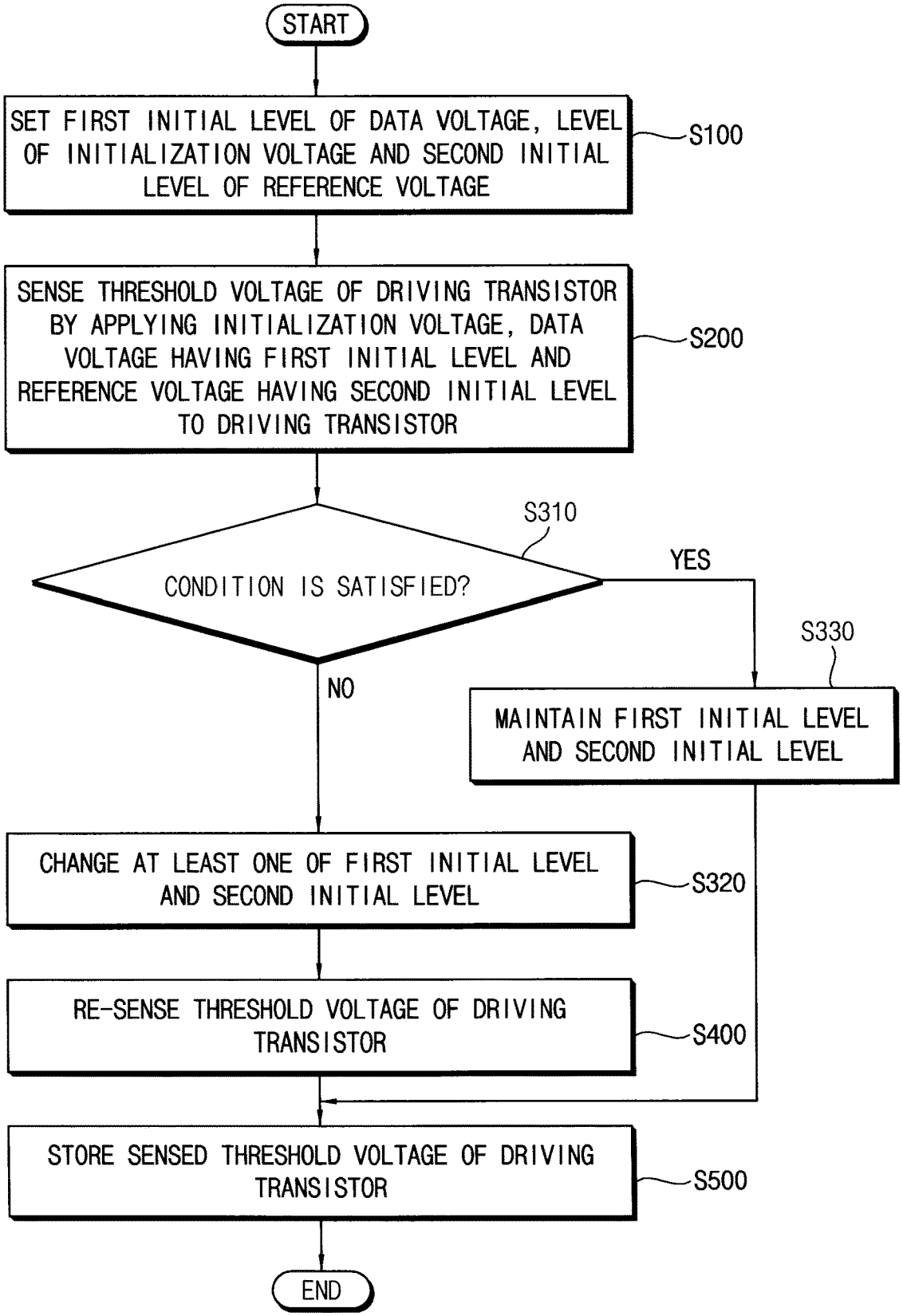
FIG. 11 is a flowchart illustrating a method of sensing a threshold voltage in a display panel according to example embodiments.

FIG. 11 is a flowchart illustrating a method of sensing a threshold voltage in a display panel according to example embodiments. The descriptions repeated with FIG. 1 will be omitted.

Referring to FIG. 11, in a method of sensing a threshold voltage in a display panel according to example embodiments, operations S100, S200, S310, S320, S330 and S400 in FIG. 11 may be substantially the same as operations S100, S200, S310, S320, S330 and S400 in FIG. 1, respectively.

After the operation of sensing the threshold voltage is completed, the sensed threshold voltage of the driving transistor may be stored (S500).

Figure 12:
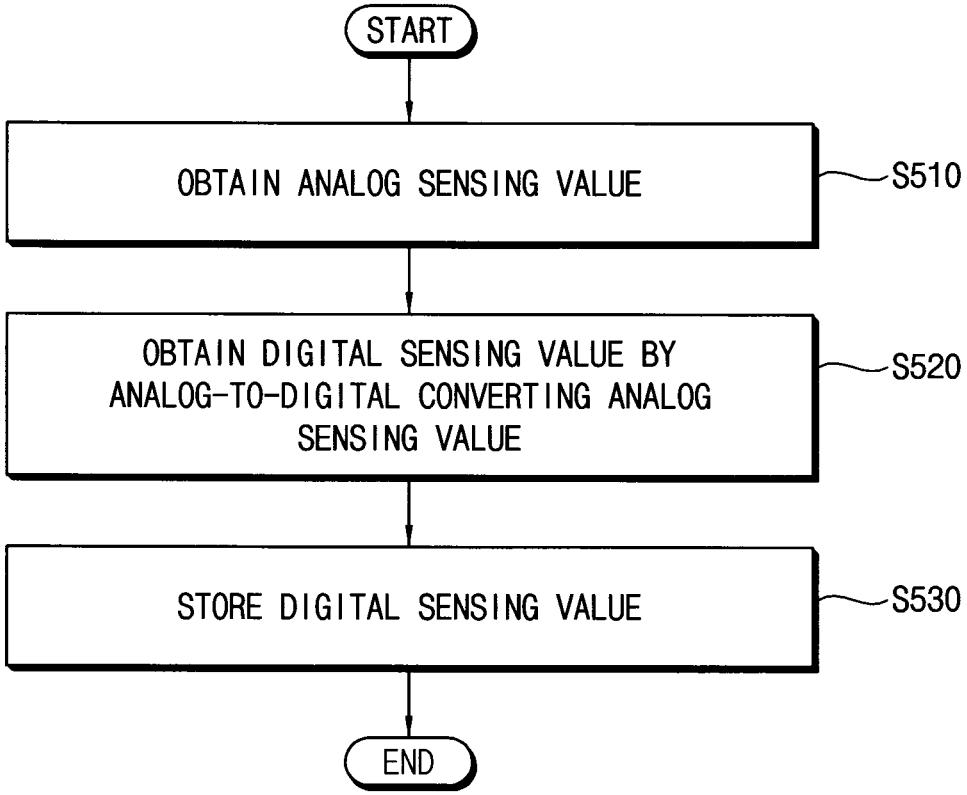
FIG. 12 is a flowchart illustrating an example of storing a sensed threshold voltage of a driving transistor in FIG. 11.

FIG. 12 is a flowchart illustrating an example of storing a sensed threshold voltage of a driving transistor in FIG. 11.

Referring to FIGS. 11 and 12, when storing the sensed threshold voltage of the driving transistor (S500), an analog sensing value may be obtained (S510). According to an embodiment, the analog sensing value may be obtained by subtracting a level of the threshold voltage and the second initial level of the reference voltage from the first initial level of the data voltage. Next, a digital sensing value may be obtained by analog-to-digital converting the analog sensing value (S520), and the digital sensing value may be stored (S530). Operations S510 and S520 may be performed by the sensing circuit SU and the analog-to-digital converter ADC in FIG. 2, and operation S530 may be performed by the memory 180 in FIG. 2.

Figure 13:
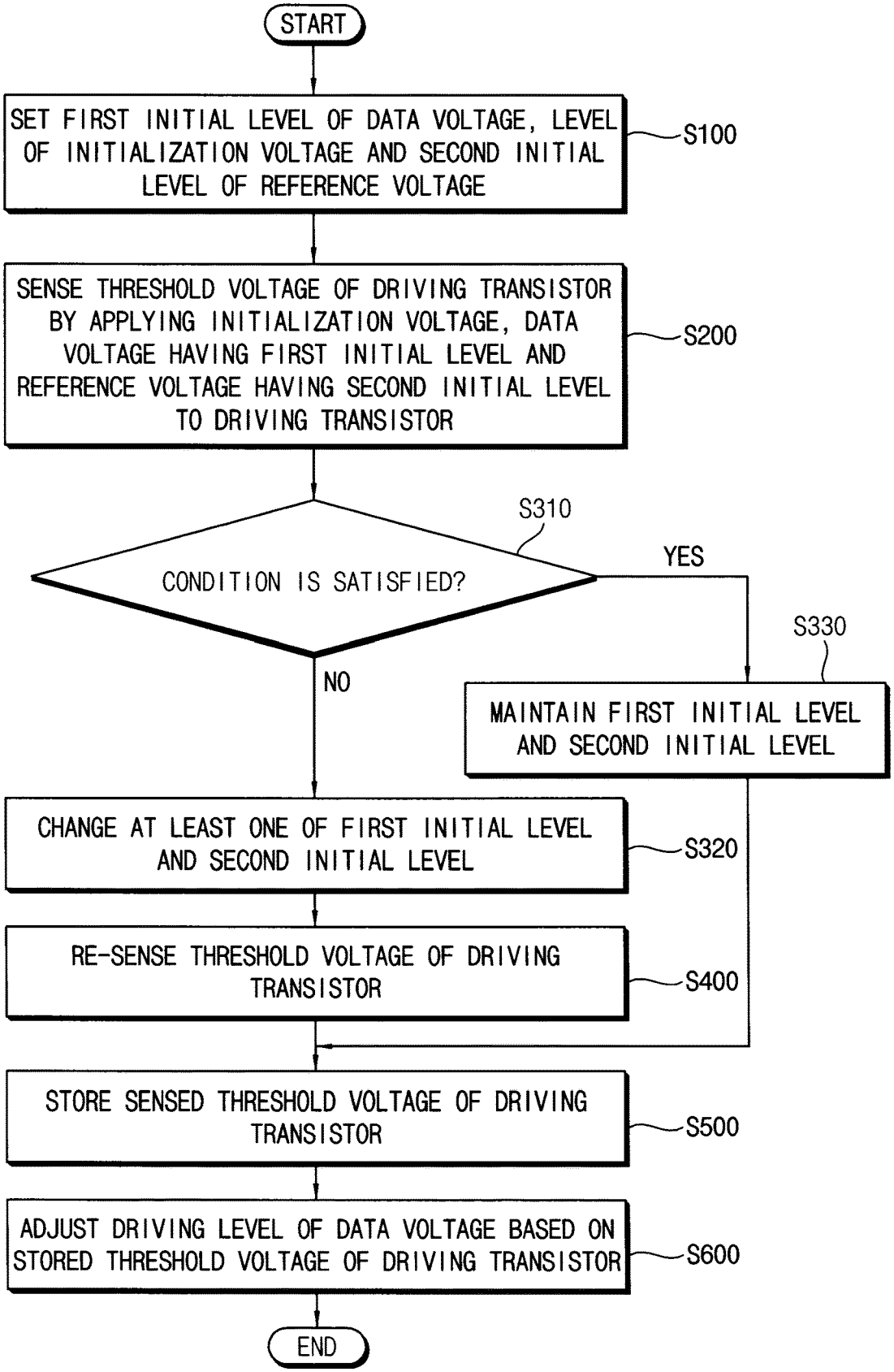
FIG. 13 is a flowchart illustrating a method of sensing a threshold voltage in a display panel according to example embodiments.

FIG. 13 is a flowchart illustrating a method of sensing a threshold voltage in a display panel according to example embodiments. The descriptions repeated with FIGS. 1 and 11 will be omitted.

Referring to FIG. 13, in a method of sensing a threshold voltage in a display panel according to example embodiments, operations S100, S200, S310, S320, S330 and S400 in FIG. 13 may be substantially the same as operations S100, S200, S310, S320, S330 and S400 in FIG. 1, respectively. Also, operation S500 in FIG. 13 may be substantially the same as operation S500 in FIG. 11.

Based on the stored threshold voltage of the driving transistor, a driving level of the data voltage that is used for driving the pixel may be adjusted (S600). For example, as described with reference to FIG. 2, S600 may be performed by the data driver 120. For another example, as will be described with reference to FIG. 2, step S600 may be performed by the timing controller 150.

According to example embodiments, the data voltage VDAT, the initialization voltage VINIT and the reference voltage VREF that is different and distinguished from the initialization voltage VINIT may be used for sensing the threshold voltage of the driving transistor included in each pixel. At least one of the level of the data voltage VDAT and the reference voltage VREF may be dynamically changed according to the variation in the threshold voltage. Accordingly, the sensing time of the threshold voltage of the driving transistor may be minimized, and the threshold voltage may be effectively sensed or detected.

As will be appreciated by those skilled in the art, the features of the example embodiments of the disclosure may be embodied as a system, method, computer program product, and/or a computer program product embodied in one or more computer readable medium(s) having computer readable program code embodied thereon. The computer readable program code may be provided to a processor of a general purpose computer, special purpose computer, or other programmable data processing apparatus. The computer readable medium may be a computer readable signal medium or a computer readable storage medium. The computer readable storage medium may be any tangible medium that can contain or store a program for use by or in connection with an instruction execution system, apparatus, or device. For example, the computer readable medium may be a non-transitory computer readable medium.

Figure 14:
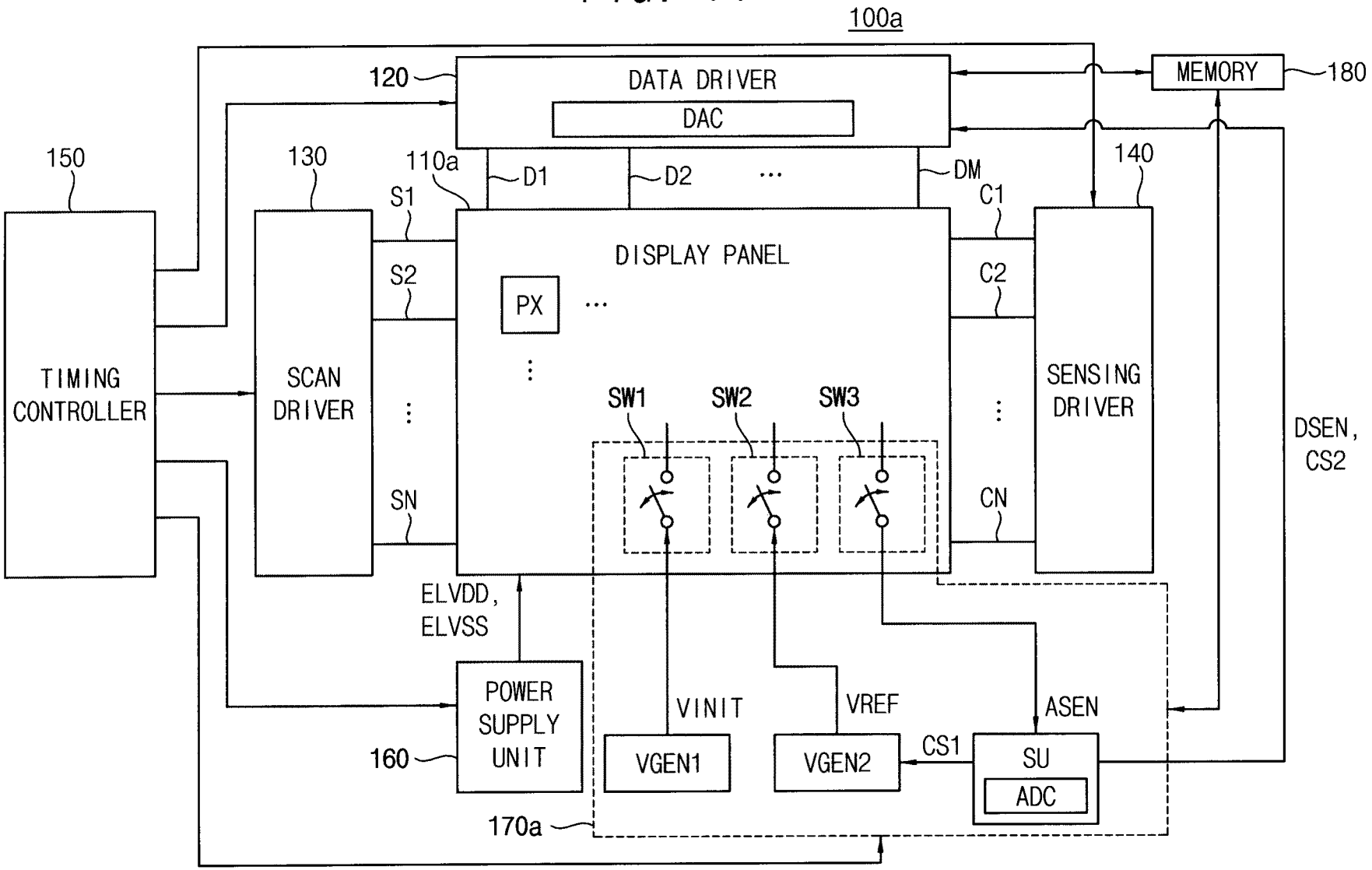
FIGS. 14 and 15 are block diagrams illustrating a display driver integrated circuit and a display device including the display driver integrated circuit according to example embodiments.
Figure 15:
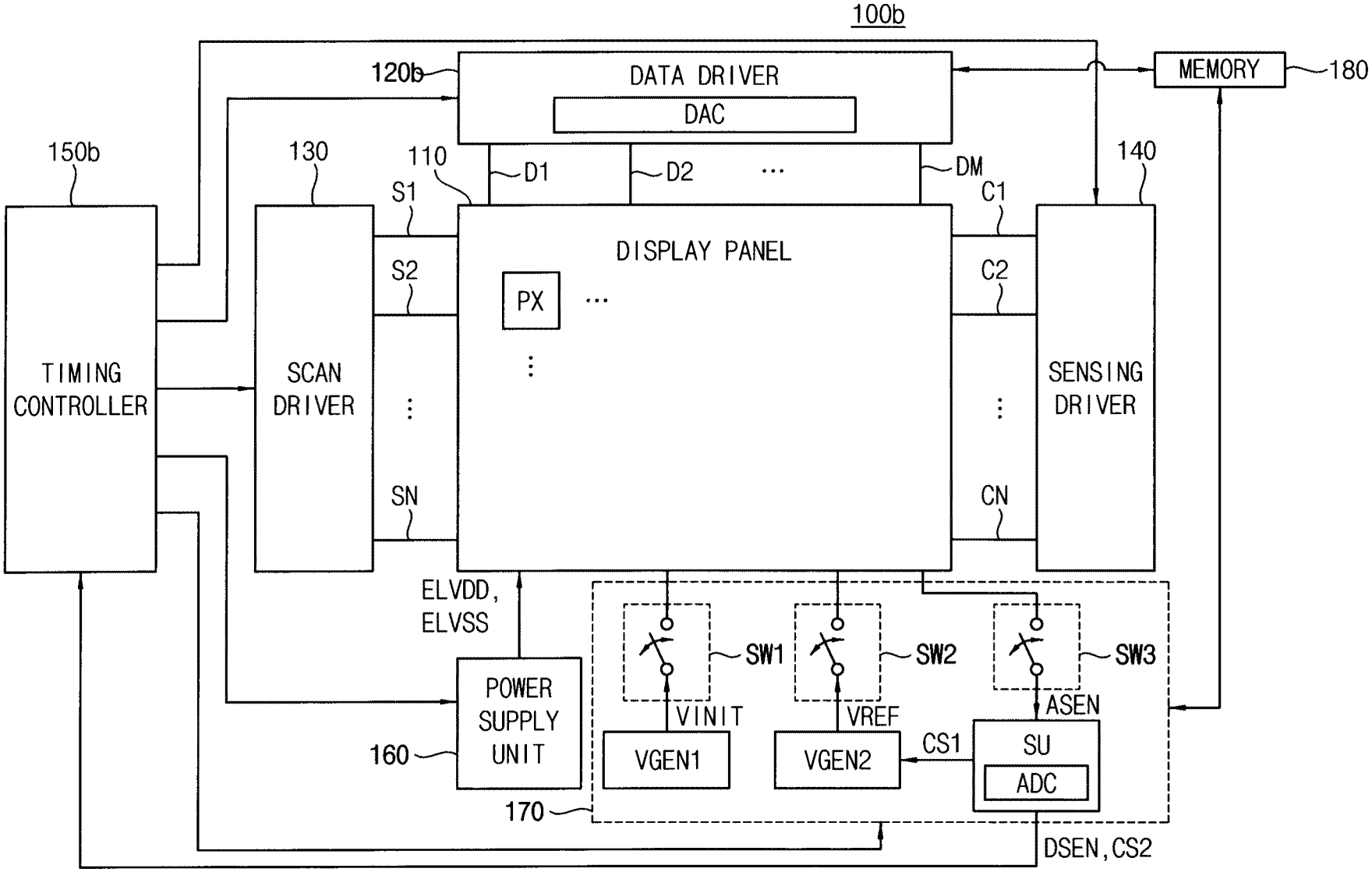

FIGS. 14 and 15 are block diagrams illustrating a display driver integrated circuit and a display device including the display driver integrated circuit according to example embodiments. The descriptions repeated with FIG. 2 will be omitted.

Referring to FIG. 14, a display device 100*a* includes a display panel 110*a* and a display driver integrated circuit. The display driver integrated circuit may include a data driver 120, a scan driver 130, a sensing driver 140, a timing controller 150, a power supply unit 160, a sensing block 170*a* and a memory 180.

The display device 100*a* of FIG. 14 may be substantially the same as the display device 100 of FIG. 2, except that configurations of the display panel 110*a* and the sensing block 170*a* are partially changed in FIG. 14.

In an example of FIG. 14, the sensing block 170*a* may include a first voltage generator VGEN1, a second voltage generator VGEN2, a sensing circuit SU, a first switch SW1, a second switch SW2 and a third switch SW3. Unlike the first, second and third switches SW1, SW2 and SW3 in FIG. 2, the first, second and third switches SW1, SW2 and SW3 in FIG. 14 may be included in the display panel 110*a* and disposed on the display panel 110*a*. In other words, the first, second and third switches SW1, SW2 and SW3 in FIG. 14 may be disposed at a panel-side.

Referring to FIG. 15, a display device 100*b* includes a display panel 110 and a display driver integrated circuit. The display driver integrated circuit may include a data driver 120*b*, a scan driver 130, a sensing driver 140, a timing controller 150*b*, a power supply unit 160, a sensing block 170 and a memory 180.

The display device 100*b* of FIG. 15 may be substantially the same as the display device 100 of FIG. 2, except that operations of the data driver 120*b* and the timing controller 150*b* are partially changed in FIG. 15.

In an example of FIG. 15, the second control signal CS2 and the digital sensing value DSEN generated by the sensing circuit SU may be provided to the timing controller 150*b* instead of the data driver 120*b*. The timing controller 150*b* may control the data driver 120*b* based on the second control signal CS2 to adjust the first initial level of the data voltage, and may adjust a value of the input image data and/or the data signal based on the digital sensing value DSEN to adjust the driving level of the data voltage that is used for driving each pixel PX (e.g., for displaying the image).

Figure 16:
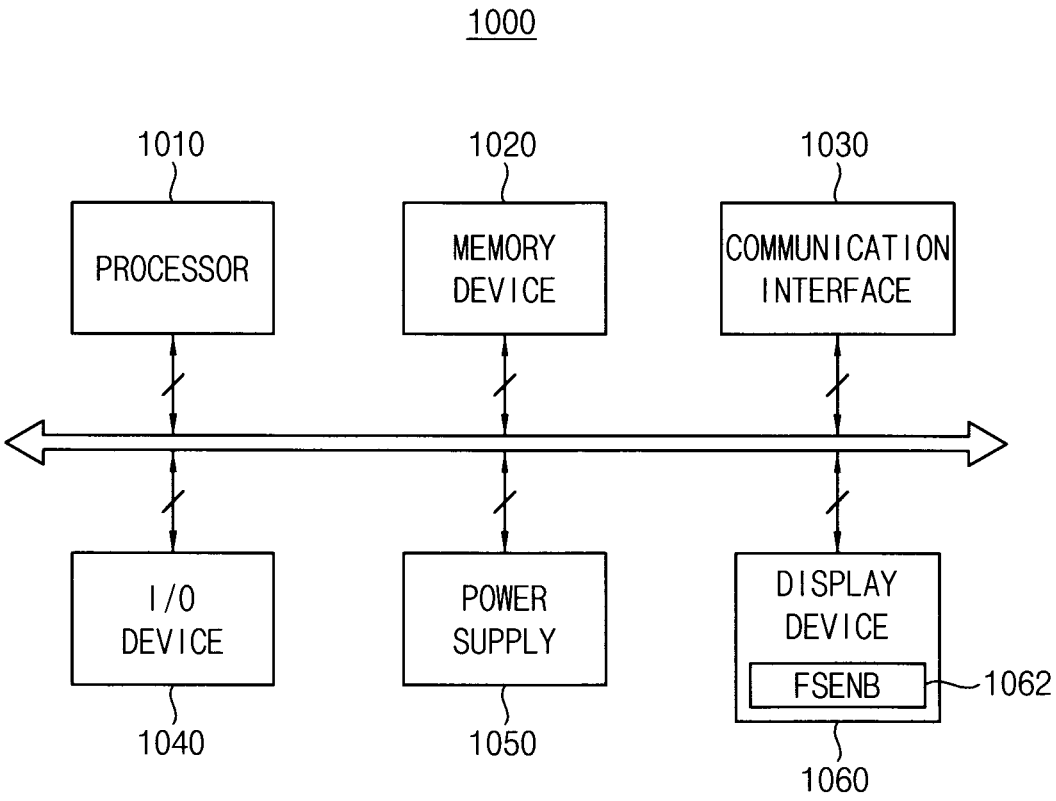
FIG. 16 is a block diagram illustrating an electronic system according to example embodiments.

FIG. 16 is a block diagram illustrating an electronic system according to example embodiments.

Referring to FIG. 16, an electronic system 1000 may include a processor 1010, a memory device 1020, a communication interface 1030, an input/output (I/O) device 1040, a power supply 1050 and a display device 1060. The electronic system 1000 may further include a plurality of ports for communicating a video card, a sound card, a memory card, a universal serial bus (USB) device, other electronic devices, etc.

The processor 1010 controls operations of the electronic system 1000. The processor 1010 may execute an operating system and at least one application to provide an internet browser, games, videos, or the like. The memory device 1020 may store data for the operations of the electronic system 1000. The commutation interface 1030 may communicate with an external device and/or system. The I/O device 1040 may include an input device such as a keyboard, a keypad, a mouse, a touchpad, a touch-screen, a remote controller, etc., and an output device such as a printer, a speaker, etc. The power supply 1050 may provide a power for operations of the electronic system 1000.

The display device 1060 includes a display panel and a display driver integrated circuit. The display device 1060 and the display driver integrated circuit may be the display device and the display driver integrated circuit according to example embodiments, respectively. The display driver integrated circuit may include a fast sensing block (FSENB) 1062 for sensing a threshold voltage of a driving transistor included in each pixel, and may perform the operation of sensing the threshold voltage according to example embodiments.

The features of the example embodiments of the disclosure may be applied to various electronic devices and/or systems including the display devices. For example, the features of the example embodiments of the disclosure may be applied to systems such as a mobile phone, a smart phone, a tablet computer, a laptop computer, a personal digital assistant (PDA), a portable multimedia player (PMP), a digital camera, a portable game console, a music player, a camcorder, a video player, a navigation device, a wearable device, an internet of things (IoT) device, an internet of everything (IoE) device, an e-book reader, a virtual reality (VR) device, an augmented reality (AR) device, a robotic device, etc.

The foregoing is illustrative of example embodiments and is not to be construed as limiting thereof. Although some example embodiments have been described, those skilled in the art will readily appreciate that many modifications are possible in the example embodiments without materially departing from the novel teachings and advantages of the example embodiments. Accordingly, all such modifications are intended to be included within the scope of the example embodiments as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of sensing a threshold voltage of a driving transistor in a pixel included in a display panel, the method comprising:

setting a first voltage level of a data voltage, a second voltage level of an initialization voltage and a third voltage level of a reference voltage, the reference voltage being different from the initialization voltage;

sensing the threshold voltage of the driving transistor by applying the initialization voltage having the second voltage level, the data voltage having the first voltage level and the reference voltage having the third voltage level to the driving transistor;

based on a charging time condition or a charging voltage condition related to the sensed threshold voltage not being satisfied, changing at least one of the first voltage level of the data voltage or the third voltage level of the reference voltage; and sensing the threshold voltage of the driving transistor again based on a result of the changing at least one of the first voltage level of the data voltage or the third voltage level of the reference voltage, wherein the charging time condition is a condition where a charging time of an electrode of the driving transistor to which the initialization voltage and the reference voltage are applied is greater than or equal to a first time.

2. The method of claim 1, wherein the charging voltage condition is a condition where a charging voltage of an electrode of the driving transistor to which the initialization voltage and the reference voltage are applied has a fourth voltage level greater than or equal to a predetermined voltage level.

3. The method of claim 1, wherein changing at least one of the first voltage level and the third voltage level comprises adjusting the third voltage level of the reference voltage.

4. The method of claim 3, wherein adjusting the third voltage level of the reference voltage comprises decreasing the third voltage level of the reference voltage when the threshold voltage of the driving transistor increases.

5. The method of claim 1, wherein changing at least one of the first voltage level of the data voltage or the third voltage level of the reference voltage comprises adjusting the first voltage level of the data voltage.

6. The method of claim 5, wherein adjusting the first voltage level of the data voltage comprises increasing the first voltage level of the data voltage when the threshold voltage of the driving transistor increases.

7. The method of claim 1, further comprising:

storing the sensed threshold voltage of the driving transistor.

8. The method of claim 7, wherein the storing the sensed threshold voltage of the driving transistor comprises:

obtaining an analog sensing value by subtracting a fourth voltage level of the threshold voltage and the third voltage level of the reference voltage from the first voltage level of the data voltage;

obtaining a digital sensing value by analog-to-digital converting the analog sensing value; and storing the digital sensing value.

9. The method of claim 7, further comprising:

adjusting, based on the stored threshold voltage of the driving transistor, a driving voltage level of the data voltage that is used for driving the pixel.

10. The method of claim 1, wherein:

the data voltage is applied to a gate electrode of the driving transistor, and the initialization voltage and the reference voltage are applied to a first electrode of the driving transistor, the first electrode being different from the gate electrode.

11. A display driver integrated circuit for driving a display panel including a plurality of pixels, each of the plurality of pixels including a driving transistor, the display driver integrated circuit comprising:

a first voltage generator configured to generate an initialization voltage;

a second voltage generator configured to generate a reference voltage, the reference voltage being different from the initialization voltage;

a data driver configured to generate a data voltage;

a memory configured to store a first voltage level of the data voltage, a second voltage level of the initialization voltage and a third voltage level of the reference voltage; and a sensing circuit configured to:

sense the threshold voltage of the driving transistor when the first voltage level of the data voltage, the second voltage level of the initialization voltage and the third voltage level of the reference voltage are applied to the driving transistor, generate a control signal based on a charging time condition or a charging voltage condition related to the sensed threshold voltage not being satisfied, for changing at least one of the first voltage level of the data voltage and the third voltage level of the reference voltage, and sense the threshold voltage of the driving transistor again based on a result of the changing at least one of the first voltage level of the data voltage and the third voltage level of the reference voltage, wherein the sensing circuit is configured to:

generate a first control signal for adjusting the third voltage level of the reference voltage when the charging time condition or the charging voltage condition is not satisfied, and provide the first control signal to the second voltage generator.

12. The display driver integrated circuit of claim 11, further comprising:

a first switch disposed between the first voltage generator and the driving transistor, and configured to control an application timing of the initialization voltage;

a second switch disposed between the second voltage generator and the driving transistor, and configured to control an application timing of the reference voltage; and a third switch disposed between the sensing circuit and the driving transistor, and configured to control a timing at which the threshold voltage of the driving transistor is sensed.

13. The display driver integrated circuit of claim 11, wherein the sensing circuit is configured to:

generate a second control signal for adjusting the first voltage level of the data driver when the charging time condition or the charging voltage condition is not satisfied, and provide the second control signal to the data driver.

14. The display driver integrated circuit of claim 11, wherein the sensing circuit comprises:

an analog-to-digital converter configured to convert the sensed threshold voltage of the driving transistor into a digital sensing value.

15. The display driver integrated circuit of claim 14, wherein:

the digital sensing value is provided to the data driver, and the data driver is configured to adjust, based on the digital sensing value, a driving voltage level of the data voltage that is used for driving the pixel.

16. The display driver integrated circuit of claim 14, further comprising:

a timing controller configured to control an operation of the data driver, wherein the digital sensing value is provided to the timing controller, and wherein the timing controller is configured to adjust, based on the digital sensing value, a value of image data that is used for driving the pixel.

17. A display device comprising:

a display panel comprising a plurality of pixels, each comprising a driving transistor;

a data driver connected to a plurality of data lines of the display panel, and configured to generate a data voltage applied to the driving transistor;

a scan driver connected to a plurality of scan lines of the display panel;

a sensing driver connected to the display panel, and configured to control an operation of sensing a threshold voltage of the driving transistor;

a first voltage generator configured to generate an initialization voltage;

a second voltage generator configured to generate a reference voltage, the reference voltage being different from the initialization voltage;

a memory configured to store a first voltage level of the data voltage, a second voltage level of the initialization voltage and a third voltage level of the reference voltage;

wherein the sensing driver is configured to:

sense the threshold voltage of the driving transistor when the initialization voltage having the second voltage level, the data voltage having the first voltage level and the reference voltage having the third voltage level are applied to the driving transistor, generate a control signal based on a charging time condition or a charging voltage condition related to the sensed threshold voltage not being satisfied, for changing at least one of the first voltage level of the data voltage and the third voltage level of the reference voltage, and sense the threshold voltage of the driving transistor again based on a result of the changing at least one of the first voltage level and the third voltage level, wherein the charging time condition is a condition where a charging time of an electrode of the driving transistor to which the initialization voltage and the reference voltage are applied is greater than or equal to a first time.

18. The display device of claim 17, wherein the display panel comprises:

a first switch disposed between the first voltage generator and the driving transistor, and configured to control a timing of applying the initialization voltage;

a second switch disposed between the second voltage generator and the driving transistor, and configured to control a timing of applying the reference voltage; and a third switch disposed between the sensing circuit and the driving transistor, and configured to a timing of sensing the threshold voltage of the driving transistor.

* * * * *